US005571226A

United States Patent [19]

Kobayashi

[11] Patent Number: 5,571,226

[45] Date of Patent: Nov. 5, 1996

[54] HYDRAULIC DEVICE FOR CONSTRUCTION MACHINERY

[75] Inventor: Takahiro Kobayashi, Akashi, Japan

[73] Assignee: Kabushiki Kaisha Kobe Seiko Sho, Kobe, Japan

[21] Appl. No.: 301,875

[22] Filed: Sep. 7, 1994

[30] Foreign Application Priority Data

Sep. 7, 1993 [JP] Japan ..... 5-221836
Dec. 28, 1993 [JP] Japan ..... 5-333951

[51] Int. Cl.[6] ..... G05D 1/02

[52] U.S. Cl. ..... 37/348; 91/421; 60/452

[58] Field of Search ..... 37/348, 382, 416, 37/414, 420, 426; 364/424.07; 91/421, 446, 447; 60/452, 450; 414/694, 695.5; 137/596, 596.13

[56] References Cited

U.S. PATENT DOCUMENTS

| | | | |
|---|---|---|---|
| 4,446,890 | 5/1984 | Simpson, Jr. | 91/421 X |
| 4,694,731 | 9/1987 | Budzich | 91/421 |
| 4,793,238 | 12/1988 | Budzich | 91/421 |
| 4,955,283 | 9/1990 | Hidaka et al. | 91/447 |
| 5,083,430 | 1/1992 | Hirata et al. | 60/452 X |
| 5,152,140 | 10/1992 | Hirata et al. | 91/446 X |
| 5,168,705 | 12/1992 | Hirata et al. | 60/452 |
| 5,203,678 | 4/1993 | Sugiyama et al. | 60/452 X |
| 5,218,897 | 6/1993 | Shirai et al. | 91/447 X |
| 5,251,444 | 10/1993 | Ochiai et al. | 91/446 X |
| 5,274,557 | 12/1993 | Moriya et al. | 37/348 X |

*Primary Examiner*—Terry Lee Melius
*Assistant Examiner*—Victor Batson
*Attorney, Agent, or Firm*—Oblon, Spivak, McClelland, Maier, & Neustadt, P.C.

[57] ABSTRACT

A hydraulic device for construction machinery includes a hydraulic pump; a hydraulic actuator having two fluid chambers; actuator fluid lines leading from each of the fluid chambers; pump fluid line leading from the pump; fluid tank fluid line leading to the fluid tank; operating lever to be operated by an operator; a direction switching unit connected to the actuator lines, the fluid tank fluid line, and the pump fluid line, and which is controlled in accordance with the direction of operation of the operating lever; inflow variable restriction located between the pump and the actuator fluid lines and whose restriction area is controlled in accordance with the degree of operation of the operating lever; outflow variable restriction located in between the fluid tank and the actuator fluid lines; and a pressure difference controller for controlling the difference in pressure between the inlet and exit ports of the inflow variable restriction. The restriction areas of the inflow and outflow variable restrictions may be controlled independently and the outflow variable restriction is controlled in accordance with fluctuations in the fluid pressure of the inlet chamber of the actuator thereby preventing the occurrence of cavitation whilst still ensuring the desirable control characteristic that the actuator drive speed corresponds to the degree of operation of the operating lever.

15 Claims, 12 Drawing Sheets

HYDRAULIC DEVICE FOR CONSTRUCTION MACHINERY

BACKGROUND OF THE INVENTION

This invention relates to a hydraulic device for use in construction machinery.

A typical hydraulic shovel is comprised of an arm, a boom, a hydraulic cylinder for driving a bucket, an actuator such as a hydraulic motor, and an operating lever for an operator to control the above, wherein hydraulic fluid is .supplied to the actuator in accordance with the operation of the operating lever to thereby drive the actuator. In such devices, a directional control valve is usually installed between the actuator and the hydraulic pump as means for changing the operating direction of the actuator. This directional control valve is switched, thereby switching the direction of the flow of hydraulic fluid through the actuator, in accordance with the direction of operation of the operating lever.

In these kinds of hydraulic devices, the employment of a so-called load sensing system is commonly known. This system works such that the supply of hydraulic fluid to the actuator is in accordance with the degree of operation of the operating lever regardless of the load on the actuator thereby achieving a actuator drive speed which corresponds to the degree of operation of the operating lever.

In this load sensing system, the position of the spool of the directional control valve is typically changed in proportion to the degree of operation of the operating lever, such that the opening area of the directional control valve is changed in proportion to the degree of operation of the operating lever. Furthermore, a pressure compensator comprising for example a pressure compensator valve is also provided such that the pressure difference between hydraulic pressure on the exit port side of the directional valve which is linked to the inlet chamber of the actuator, (equivalent to the load pressure on the actuator) and the hydraulic pressure on the inlet port side of the directional control valve is controlled to a predetermined value, thereby ensuring that the amount of flow of fluid through the actuator is in proportion to the opening area and therefore in proportion to the degree of operation of the operating lever.

By using this kind of load sensing system, even if the load on the actuator changes during operation, a flow of hydraulic fluid corresponding to the degree of operation of the operating lever is supplied to the actuator, therefore making it possible to achieve an actuator drive speed corresponding to the degree of operation of the operating lever and hence the controllability of the actuator is enhanced.

However, in these kinds of hydraulic devices for construction machinery, the hydraulic fluid on the exit side of the actuator flows to the fluid tank through an exit passage formed in the directional control valve. In this exit passage there is formed a restriction whose restriction area changes in accordance with the position oil said spool, in other words, in proportion to the degree of operation of the operating lever. As a consequence, in the case where for example the degree of operation of the operating lever is held constant and the drive speed of the actuator is maintained constant, and if the change in load on the actuator is only slight or if the change in load over time is smooth, then the amount of fluid flowing from the actuator is almost identical to the amount of fluid flowing to the actuator, which is in proportion to the degree of control of the operating lever, and a stable actuator drive speed can be achieved.

However, as a result of the nature of the work of these kinds of construction machinery, there are many cases of the load on the actuator suddenly changing. For example a load acting in the opposite direction to that of the direction of drive of the actuator may suddenly change to act in the same direction as the direction of drive of the actuator. In these kinds of cases, irrespective of the amount of flow of fluid flowing to the actuator, (which is in proportion to the degree of control of the operating lever), a force works to increase the drive speed of the actuator and if the drive speed continues to increase the fluid pressure in the exit chamber of the actuator decreases. It is well known that if the fluid pressure in the exit chamber of the actuator falls below a critical pressure, cavitation occurs and causes erosion of the actuator etc. and furthermore that under the kind of conditions where cavitation occurs, the operation of the actuator can easily become unstable.

As mentioned above, in existing hydraulic devices for construction machines, the restriction area simply changes in accordance with the degree of operation of the operating lever. Thus when said restriction area is relatively large corresponding to a relatively large degree of operation of the operating lever, and the drive speed of the actuator starts to increase as a result of a change in load on the actuator as mentioned above, since the resistance to the flow of fluid from the actuator is small, the amount of fluid flowing from the actuator increases with a consequent increase in the drive speed of the actuator. As a result, these devices were prone to cavitation and to the operation of the actuator often became unstable.

In an attempt to resolve these problems, there are devices in which the restriction area of the exit passage of the directional control valve is set to a small value even when the degree of operation of the control lever is relatively large. However, in these kinds of devices, because the restriction area of the exit passage is set to be small regardless of the degree of operation of the operating lever, for various drive conditions of the actuator, the resistance to the flow of fluid from the actuator is large thereby causing an increase in the loss of pressure with a consequent decrease in the energy efficiency of the device.

There are also hydraulic devices for construction machinery, which employ so-called "Bleed-off" control which do not use pressure compensators. In these devices, as a result of the particular construction cavitation does not easily occur. However, because the amount of fluid supplied to the actuator can change even when the degree of operation of the operating lever is maintained constant it becomes difficult to obtain an actuator drive speed corresponding to the degree of operation of the operating lever.

SUMMARY OF THE INVENTION

It is the object of the present invention to provide a hydraulic device for construction machinery in which a stable and efficient and actuator drive speed corresponding to a degree of control of an operating lever may be obtained and in which, in the case of sudden load fluctuations, the occurrence of cavitation is prevented.

The above object is achieved through the provision of a hydraulic device for construction machinery comprising a hydraulic pump; a hydraulic actuator having two fluid chambers; actuator fluid lines leading from each of said fluid chambers; pump fluid line leading from said pump; fluid tank fluid line leading to said fluid tank; operating lever to be operated by an operator; a direction switching unit connected to said actuator lines, said fluid tank fluid line, and said pump fluid line, and which is controlled in accordance with the direction of operation of the operating lever; inflow variable restriction located between said pump and said actuator fluid lines and whose restriction area is controlled in accordance with the degree of operation of said operating lever; outflow variable restriction located in between said fluid tank and said actuator fluid lines and whose restriction area may be controlled independently of the restriction area of said inflow variable restriction and which is controlled as necessary to cope with drops in the value of the fluid pressure in the inlet chamber of said actuator; and pressure difference controlling means for controlling the difference in pressure between the inlet and exit ports of said inflow variable restriction.

According to the present invention, because for the flow of fluid into said actuator, the pressure difference between the inlet and exit ports of the inflow variable restriction is maintained at said predetermined value by said pressure difference control means, the amount of fluid flowing from said hydraulic pump to the inlet chamber of said actuator is in proportion to the restriction area of said inflow variable restriction. Then because the restriction area of said inflow variable restriction is controlled in accordance with the degree of operation of said operating lever, the amount of fluid flowing to the inlet chamber of said actuator is in accordance with the degree of operation of said operating lever, it is therefore possible to obtain an actuator drive speed corresponding to the degree of operation of said operating lever. Furthermore because the restriction area of the outflow variable restriction may be controlled independently of the restriction area of the inflow variable restriction, it may be controlled to be reduced in accordance with undesirable decreases in fluid pressure in the inlet chamber of the actuator (caused by sudden changes in load on the cylinder etc.), and therefore the resistance to the outflow of fluid from the actuator may be increased as necessary without effecting the restriction area of the inflow variable restriction. Thus a sudden decrease in pressure of hydraulic fluid in the inlet chamber of said actuator may be controlled thereby avoiding the occurrence of cavitation, without effecting the desirable control characteristic of an actuator drive speed corresponding to the degree of operation of the operating lever.

In one embodiment of this invention, said outflow variable restriction and said direction switching unit are combined in the form of a spool-type directional control valve in which the restriction area of the outflow passages changes with the displacement of the spool from a center position over the range of displacement of the spool, and in which the restriction area of the inflow passages reaches a maximum value with only a small displacement of the spool from a center position; and in that said inflow variable restriction is installed in said pump fluid line.

Because the inflow passages are designed to reach a maximum opening area with only a small displacement of the spool, the restriction area of the outflow variable restriction (i.e. the resistance to the flow of fluid out of the actuator) can be controlled by changing the displacement of the spool without effecting the resistance to the flow of fluid into the actuator which is controlled by adjustment of the restriction area of the independently controllable inflow variable restriction installed in the pump fluid line. Furthermore, by combining the direction switching unit and outflow variable restriction into a single component, it is possible to reduce the total number of component parts and achieve miniaturization of the device.

The hydraulic device may also further comprise pressure detecting means for detecting the fluid pressure of the inlet chamber; and wherein the restriction area of said outflow variable restriction is only controlled in accordance with the value of the fluid pressure in the inlet chamber of the fluid actuator when the pressure detected by said pressure detecting means is under a predetermined value.

If the pressure on the inlet chamber side of said actuator is detected to be less than a certain set value then the restriction area of said outflow variable restriction is reduced. Thus the pressure on the inlet chamber side of said actuator is prevented from decreasing to a value lower than said set value. If the critical pressure at which cavitation occurs is selected as the set value, it is possible to avoid the occurrence of cavitation. In this way, since the restriction area is only reduced on occasions when there is a danger of cavitation occurring, it is possible to reduce unnecessary pressure loss during normal operating conditions.

In another embodiment of the present invention said direction switching unit comprises a set of inflow and outflow logic valves. Because such logic valves are (i) generally small in size, (ii) can be used even at high pressures and high volumes and (iii) have the characteristic of low fluid leakage, the device can be made small and compact.

The hydraulic device may also comprise a restriction of fixed restriction area installed in parallel with said outflow variable restriction. In this case when the outflow variable restriction is closed at the time of starting said actuator, a high resistance is produced on the exit chamber side of said actuator as a result of said fixed restriction and smooth actuator drive is possible.

Other objects and features will be more fully understood from the following detailed description and appended claims when taken with the accompanying drawings.

DETAILED DESCRIPTION OF THE PREFERRED EMBODIMENTS

First Embodiment

Figure 1:
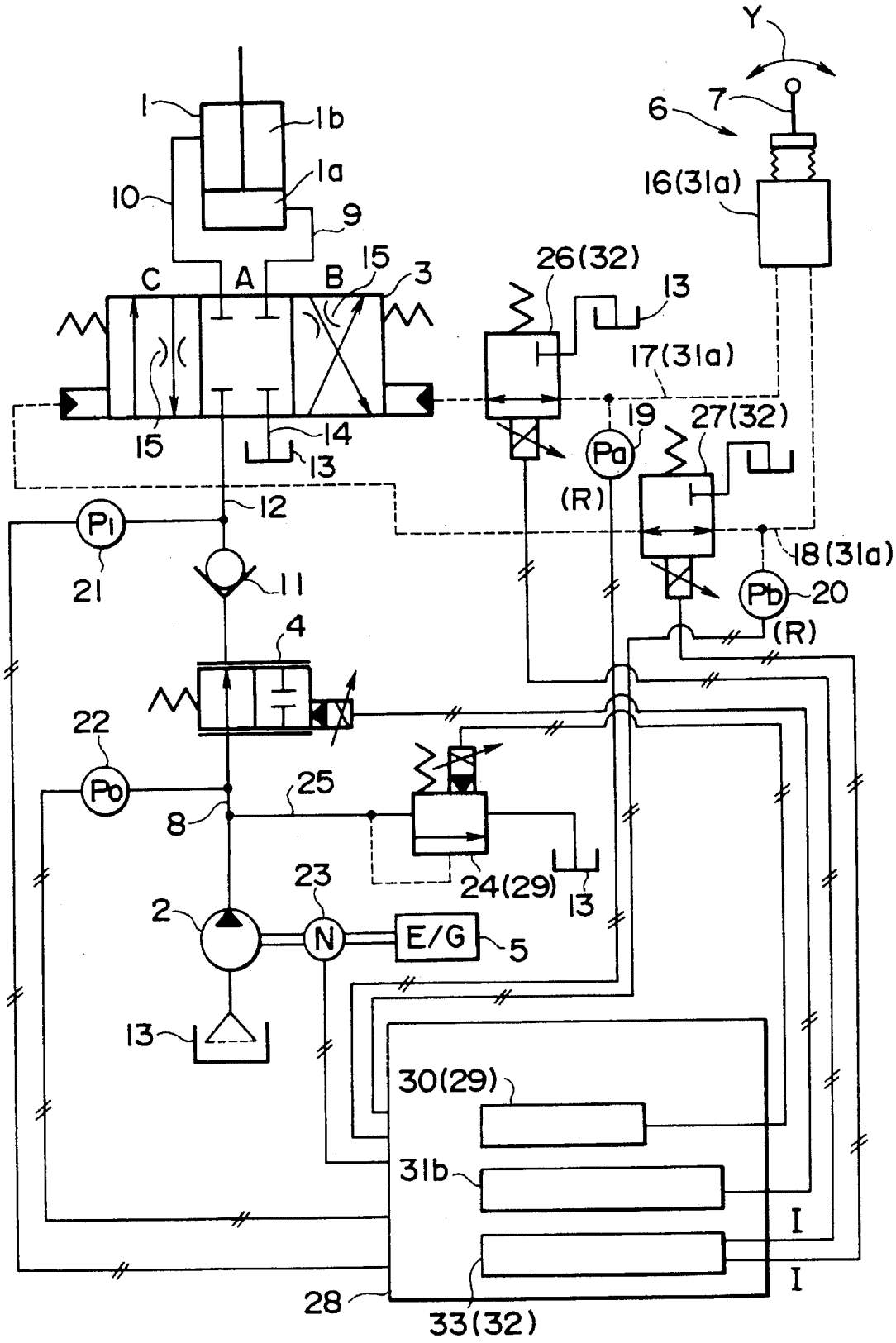
FIG. 1 shows the construction of a hydraulic device according to a first embodiment of the present invention.

With reference to FIG. 1, the first embodiment comprises a hydraulic cylinder (1) (actuator) for driving for example the arm of a hydraulic shovel (not shown); a hydraulic pump (2) for supplying hydraulic fluid to the hydraulic cylinder (1) for driving said hydraulic cylinder; a directional control valve (3) (drive direction switching means) for switching the drive direction of said hydraulic cylinder, solenoid proportional flow control valve (4) for controlling the amount of fluid flowing from said hydraulic pump (2) to said hydraulic cylinder (1); an engine (5) for driving said hydraulic pump (2); a control device (6) incorporating an operating lever (7) for the operator to control said hydraulic cylinder. The inlet port of said solenoid proportional flow control valve (4) is connected to the outlet port of the hydraulic pump (2) through a fluid line (8).

The directional control valve (3) is connected to the bottom side fluid chamber (1*a*) and the rod side fluid chamber (1*b*) of said hydraulic cylinder (1) by fluid lines (9) and (10) respectively, and to the outflow port of said solenoid proportional flow control valve (4) by fluid line (12) incorporating a check valve (11). The return port of the directional control valve is connected by fluid line (14) to fluid tank (13) which stores the fluid to be sucked and then discharged by hydraulic pump (2).

When the spool (not shown) of directional control valve (3) is in the middle position marked A, the bottom chamber (1*a*) and the rod chamber (1*b*) of the hydraulic cylinder (1) are dosed and the hydraulic cylinder is in a hold position. When the spool is moved to position marked B the bottom side fluid chamber (1*a*) is connected to hydraulic pump-side fluid line (12) and rod side fluid chamber (1*b*) is connected to fluid tank (13) by fluid line (14). Conversely, when the spool is moved to the position marked C, the bottom side fluid chamber (1*a*) and the rod side fluid chamber (1*b*) of the hydraulic cylinder (1) are connected to fluid tank (13) side fluid line (14) and hydraulic pump (1) side fluid line (12) respectively. There is an outflow variable restriction installed in the outflow passages (of directional control valve (3)) connected to the return ports for positions B and C, whose restriction area changes in accordance with the position of the spool of the directional control valve (3).

Control means (6) comprises operating lever (7) movable back and forward in direction shown by arrow Y in FIG. 1, and pilot pressure generation device (16) which generates a pilot pressure in accordance with the degree of operation of the operating lever (7). The pilot pressure generation device (16) generates a pilot pressure in accordance with the direction and in proportion to the degree of operation of the operating lever and sends it via pilot fluid lines (17) or (18) to the directional control valve (3), and the spool of the directional control valve (3) is thereby moved by an amount proportional to the pilot pressure. In this way, the spool of directional control valve (3) is switched from position A to position B side or position C side. More specifically, it for example operating lever is moved from a middle position to a forward position, a pilot pressure in proportion to said degree of operation of said operating lever is sent via pilot line (17) to the directional control valve (3) and the spool of directional control valve is consequently moved from position A towards position B. Similarly, if operating lever (7) is moved to a back position, a pilot pressure in proportion to said degree of operation of said operating lever is sent via pilot line (18) and the spool of directional control valve is moved from position A towards position C. Further, when operating lever (7) is in a central position, it lies within a so-called dead band and the spool of directional control valve is maintained in position A.

Inflow passages (of directional control valve (3)), which are connected to hydraulic pump (2) when directional control valve is in positions B or C, is, are designed such that they become fully opened when operating lever is moved either slightly backwards of forwards out of the dead band. The outflow restriction located in the outflow passages which become connected to fluid tank (13) when the spool is in position B or C are designed such that their restriction area increase in proportion to the pilot pressure, itself corresponding to the degree of operation of the operating lever (7). With further reference to FIG. 1, this embodiment also comprises pressure sensors (19) and (20) which respectively detect pilot pressures $P_a$ and $P_b$ in pilot lines (17) and (18) as R, degree of operation of operating lever (7); pressure sensor (21) which detects the solenoid proportional flow control valve (4) outflow pressure $P_1$ in fluid line (12); pressure sensor (22) which detects the solenoid proportional flow control valve (4) inflow pressure $P_0$ in fluid line (8); rotational speed sensor (23) which detects the rotational speed of the engine (5) driving hydraulic pump (2); solenoid proportional unloading valve (24) located in fluid line (25) leading from fluid line (8) to fluid tank (13); solenoid proportional pressure reducing valves (26) and (27) which are respectively located in pilot lines (17) and (18); and controller (28) which receives the detection signals from each of the sensors (19), (20), (21) and (22) and controls the solenoid proportional flow control valve (4), solenoid proportional unloading valve (24) and solenoid proportional pressure reducing valves (26) and (27).

Controller (28) is constructed of an electronic circuit comprising microcomputers etc. and in terms of functional components comprises pressure difference control component (30) (itself comprising solenoid proportional unloading valve combined with pressure difference control means (29)), inflow restriction control component (means) (31*b*) for controlling the opening area of solenoid proportional flow control valve (4), and outflow restriction control component (33) (itself comprising solenoid proportional pressure reducing value (26) and (27) combined with outlet side restriction control means (32)).

Pressure difference control component (30) controls the set pressure of the solenoid proportional flow control valve (4) in accordance with inflow pressure $P_0$ and outflow pressure $P_1$ detected by sensors (21) and (22). It controls the set pressure of solenoid proportional unloading valve (24) such that pressure $P_1$ is larger than pressure $P_0$ by the amount of the predetermined standard value, or in other words, such that the difference ($P_0$–$P_1$) between $P_0$ and $P_1$ becomes the predetermined value.

Inflow restriction control component (means) (31*b*), which will be described in detail later, sets the opening area versus degree of operating lever operation characteristic of solenoid proportional flow control valve (4) in accordance with solenoid proportional flow control valve (4) inflow pressure $P_1$ detected by sensor (21) and the rotational speed, N of engine (5) detected by rotational speed sensor (23). It also controls the opening area of solenoid proportional flow control valve (4) in accordance with the degree of operation, R, of operating lever (7) detected by either sensor (19) or (20) such that the actual opening area fits the above characteristic.

Outflow restriction control component (33), which shall also be described in detail later, controls the set pressure of solenoid proportional pressure reducing valves (26) or (27) (thereby controlling the actual pilot pressure to be sent to directional control valve (3)) such that solenoid proportional flow control valve (4) outflow pressure $P_1$ which is detected by pressure sensor (21) is larger than a predetermined critical pressure value.

Next, the operation of the device of this embodiment shall be described with reference to FIGS. 1 to 6.

In the condition when hydraulic pump (2) is driven by engine (5), if the operator moves the operating lever (7) say forward from a center position, a pilot pressure proportional to the degree of operation of said operating lever (7) is generated by pilot pressure generating device (16) and sent to directional control valve (3) via pilot line (17) and the spool of directional control valve (3) is thereby switched from position A towards position B. Consequently, the bottom side fluid chamber (1*a*) of hydraulic cylinder 1 is connected via fluid line (9) and directional control valve (3) to pump-side fluid line (12), and the rod-side fluid chamber (1*b*) is connected via fluid line (10) and the outlet side variable restriction (15) of directional control valve (3) to fluid tank side fluid line (14). In addition, the pressure reduction value of solenoid proportional pressure reducing valve (26) is set such that for any degree of operation, R of operating lever (7), a pilot pressure output by pilot pressure generating device (16) is sent unchanged to directional control valve (3).

As operation begins, if the degree of operation, R of operating lever (7), which is detected by pressure sensor (19) reaches a value Ra (See FIG. 2) which is a value at which the inflow passage of directional control valve (3) in position B becomes fully open, the controller 28 performs the following control;

The pressure difference control component (30) of controller (28) controls the pressure reduction value of solenoid proportional pressure reducing valve (24) such that the pressure difference ($P_0$–$P_1$) between solenoid proportional flow control valve (4) outflow pressure $P_1$ (i.e. the load pressure on the cylinder (1), $P_1$), which is detected by pressure sensor (21), and solenoid proportional flow control valve (4) inflow pressure $P_0$, which is detected by pressure sensor (22) becomes a predetermined standard value. Specifically, when the pressure difference, $P_0$–$P_1$, is bigger than the predetermined standard value, pressure $P_0$ is reduced by decreasing the set pressure value of solenoid proportional control valve (24), and in the opposite case when the pressure difference is smaller than the predetermined standard value, $P_0$ is increased by increasing the set pressure value of solenoid proportional control valve (24). In this way, the pressure difference ($P_0$–$P_1$) between the inlet side and exit sides of solenoid proportional flow control valve (4) is maintained at a constant value.

Figure 3:
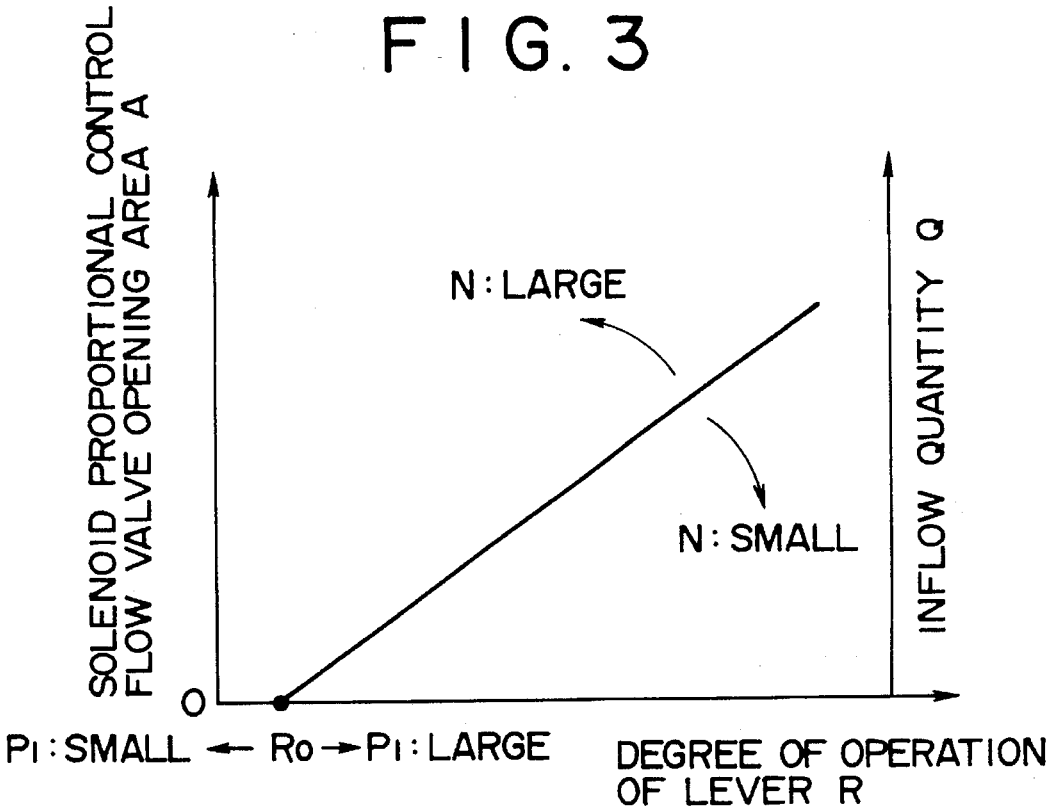
FIG. 3 is a diagram explaining the operation of the hydraulic device shown in FIG. 1.

In parallel with this control, the inflow restriction control component (31*b*) sets the opening area versus degree of operating lever operation characteristic of solenoid proportional flow control valve (4) in accordance with the load pressure on cylinder (1), $P_1$, detected by pressure sensor (21) and the rotational speed, N of the engine (5) detected by rotational speed sensor (23), as for example in the way shown in FIG. 3.

In FIG. 3, $R_0$ is the value of degree of operation, R of operating lever (7) at which solenoid proportional flow control valve (4) begins to open. An opening area versus degree of operation of operating lever characteristic of solenoid proportional flow control valve (4) is set such that when the degree of operation, R reaches a value, $R_0$, the valve begins to open and increase in opening area in proportion to the degree of operation, R, as the degree of operation, R is thereafter increased. The value $R_0$ at which the valve of solenoid proportional flow control valve (4) begins to open is set such that it increases as the load pressure on the cylinder, $P_1$, increases and such that the increase rate of the section area of the opening valve, A after R has reached Ro is larger the larger the rotation speed of the engine, N.

Then, inflow restriction control unit (31*b*) sends an electric signal in accordance with the present degree of operation, R of the operating lever detected by pressure sensor (19) to the solenoid of solenoid proportional flow control valve (4) such that A becomes the value selected in the way described above, thereby controlling the area, A, of the opening valve of solenoid proportional flow control valve (4).

Figure 4:
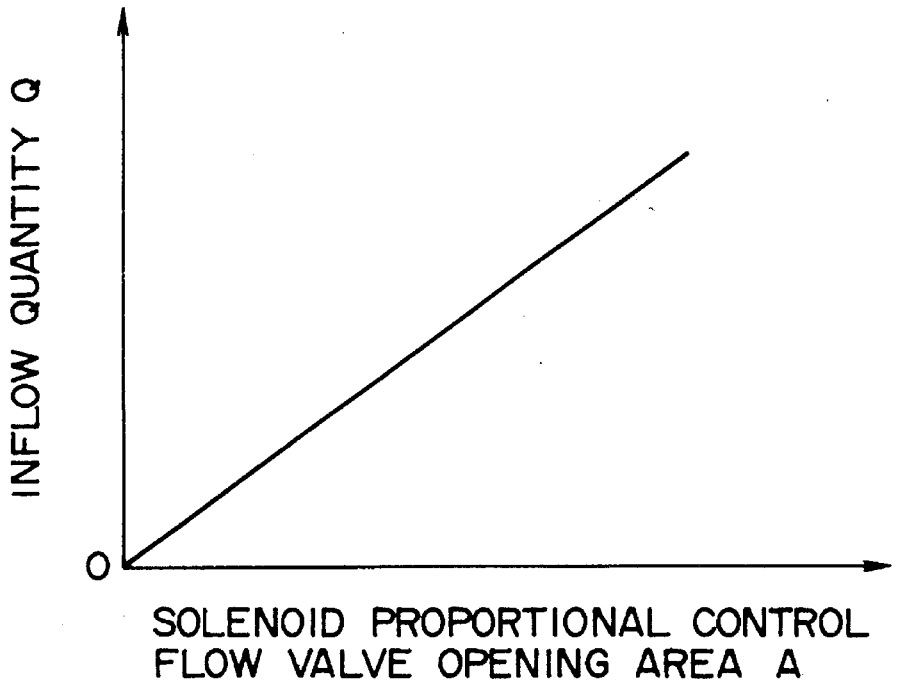
FIG. 4 is a diagram explaining the operation of the hydraulic device shown in FIG. 1.

As mentioned above, because the pressure difference ($P_0$–$P_1$) between the inlet and outlet sides of the solenoid proportional flow control valve (4) is maintained at a constant value, as shown in FIG. 4, the amount of fluid flowing through the solenoid proportional flow control valve (4) i.e. the amount of fluid flowing to the bottom side fluid chamber of the hydraulic cylinder, Q, is in proportion to the area of the opening valve of solenoid proportional flow control valve (4) and therefore, as shown in FIG. 3, the operating degree—flow amount characteristic of the amount of fluid flowing to the hydraulic cylinder, Q, is basically the same as the opening area characteristic of solenoid proportional flow control valve (4). In other words, at a degree of operation, $R_0$ corresponding to the load pressure on the cylinder $P_1$, the opening valve of solenoid proportional flow control valve (4) begins to open and fluid output from the hydraulic pump (2) begins to flow into the bottom side fluid chamber of the hydraulic cylinder via solenoid proportional flow control valve (4), fluid line 12, directional control valve (3) (in position B) and fluid line (9). As a result, the hydraulic cylinder begins to function (in this case, extension) and thereafter as the degree of operation, R of the operating lever is increased the amount of fluid flowing into the hydraulic cylinder increases by a flow amount gain corresponding to the rotation speed of the engine, N and consequently the operation speed of the hydraulic cylinder increases. In this way, it is possible to achieve an operation speed corresponding to the degree of operation R of the operating lever.

Thus, even if the load pressure on the hydraulic cylinder, $P_1$, happens to change, since the amount of fluid flowing into the hydraulic cylinder, Q does not change if the degree of operation, R of the operating lever is maintained constant, it is basically possible to obtain a cylinder operation speed corresponding to the degree of operation of the operating lever.

Furthermore, in the operation described above (i.e. when directional control valve (3) is in position B), fluid flows out of the rod-side fluid chamber (1*b*) and back to the fluid tank

Figure 2:
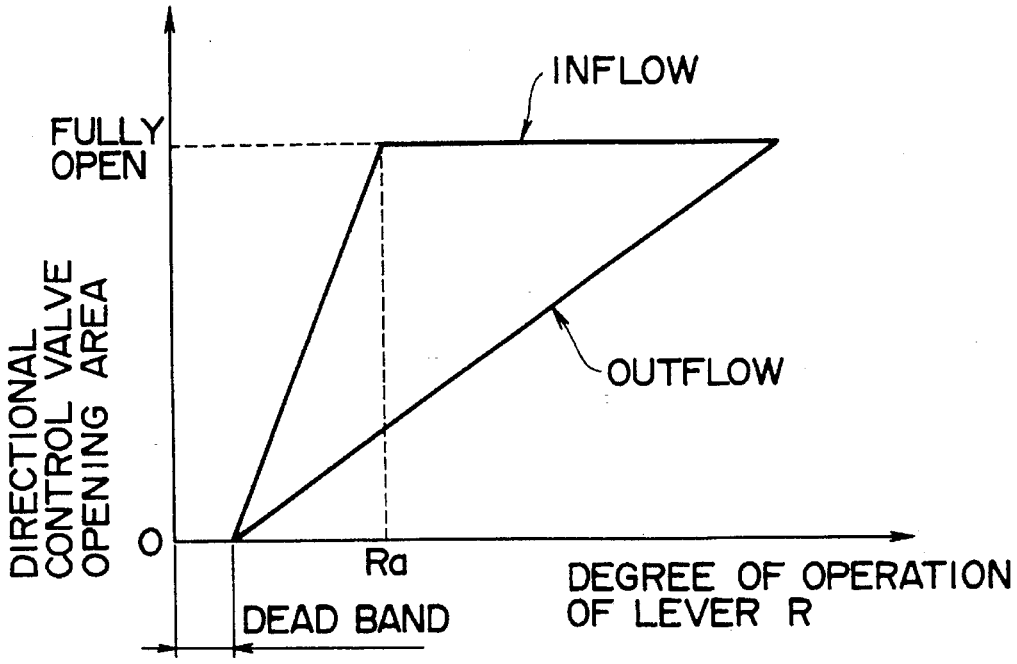
FIG. 2 is a diagram explaining the operation of the hydraulic device shown in FIG. 1.

(13) via fluid line (10), outflow variable restriction 15 of directional control valve (3) and fluid line (14). In the case that the degree of operation, R is maintained constant and the load pressure on the cylinder, $P_1$ does not change at all or only varies smoothly with time, the amount of fluid flowing from the hydraulic cylinder is almost identical to the amount of fluid flowing into the hydraulic cylinder, Q. Then, as shown in FIG. 2, since the restriction area of outflow variable restriction 15 of directional control valve (3) is maintained in near proportion to the degree of operation, R, then in the case that the opening area is relatively small corresponding to a relatively small degree of operation, R, the amount of fluid flowing out of the hydraulic cylinder is stabilized against variations in load on the cylinder and it is therefore possible to maintain a stable cylinder operation speed. Also, because the opening area of outflow variable restriction 15 is changed in accordance with the amount of fluid flowing into the hydraulic cylinder, the pressure loss on the outlet side of the hydraulic cylinder is relatively small for all values of R and it is possible to obtain a good energy efficiency.

The operation explained above is the basic operation of the hydraulic device of this embodiment and if the operating lever (7) is moved backwards and the directional valve switched to position C, the same kind of operation is carried out. In that case the operation of the cylinder is a contraction operation.

For the hydraulic device of this embodiment, when the opening area of outflow variable restriction (15) of the directional control valve is large, corresponding to a relatively large degree of operation, R of the operating lever, and if for example the direction of the load on the cylinder switches direction from a direction opposite to that of the direction of operation of the cylinder to a direction the same as the direction of operation of the cylinder, the amount of fluid flowing from the hydraulic cylinder suddenly increases and there is a tendency for the cylinder operation speed to increase suddenly. As a result, there is a tendency for the pressure of the inlet side fluid chamber (for the B position, the bottom side fluid chamber; for the C position, the rod-side fluid chamber) of the hydraulic cylinder to suddenly decrease. If the pressure of the inlet side fluid chamber of the hydraulic cylinder then decreases as far as a critical pressure, cavitation occurs inside the fluid chamber and there is the fear that the hydraulic cylinder may be damaged and/or that the operation of the cylinder may become unstable.

However, in the hydraulic device of this embodiment , the outflow restriction control component (33) of the controller (28) prevents the occurrence of such problems by monitoring the load pressure on the cylinder, $P_1$ (i.e. the pressure of the inlet side fluid chamber of the hydraulic cylinder) and adjusting and controlling the restriction area of the outflow variable restriction 15 of the directional control valve (3) in the following way.

Figure 6:
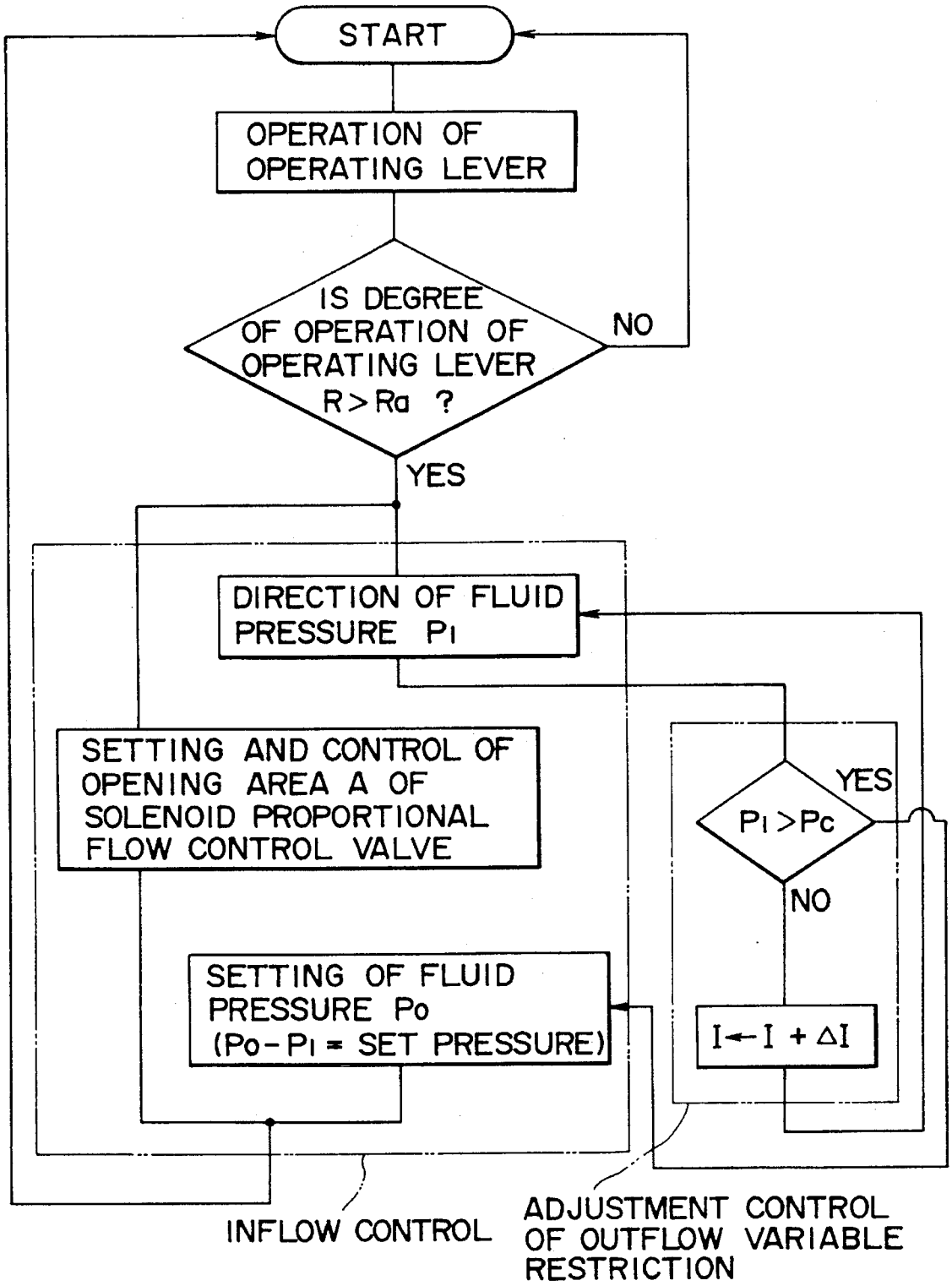
FIG. 6 is a flowchart explaining the operation of the hydraulic device shown in FIG. 1.

Referring to FIGS. 1 and 6, for operation when the directional valve is in position B, the outflow restriction control component (33) determines whether the pressure in the inlet side fluid chamber (i.e. bottom side fluid chamber (1*a*)), measured at fixed intervals of time by pressure sensor (21) has fallen below a predetermined critical pressure $P_c$, corresponding to the lowest pressure at which cavitation does not occur. In the case that $P_1 > P_c$, there is no fear that cavitation will occur and the previously described operation is allowed to continue.

Figure 5:
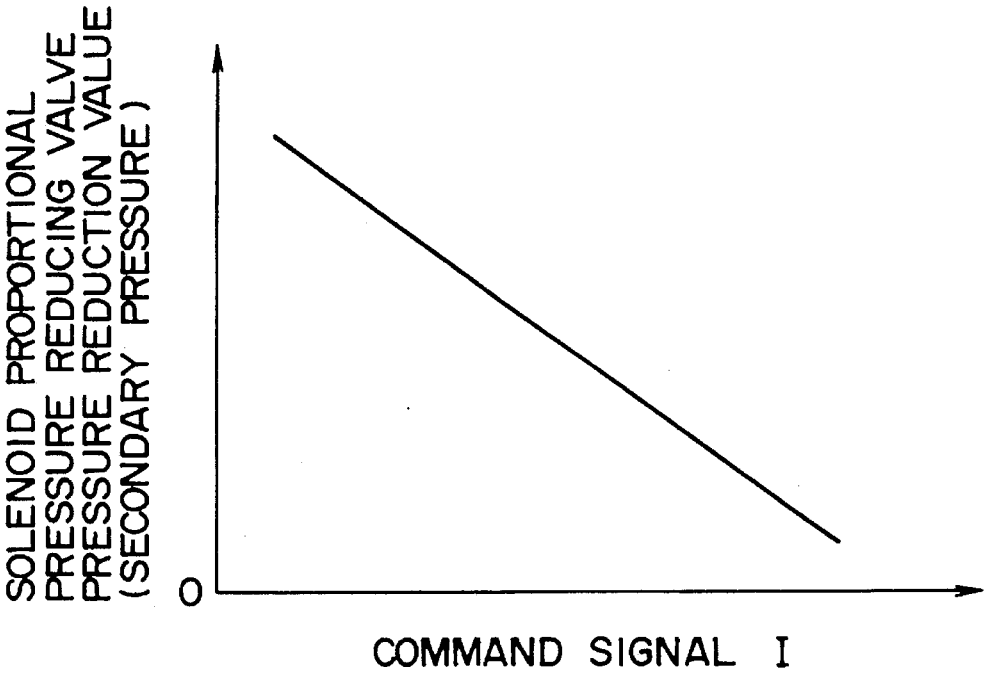
FIG. 5 is a diagram explaining the operation of the hydraulic device shown in FIG. 1.

On the other hand, if the pressure $P_1$ has fallen below the critical pressure $P_c$, the outflow restriction control component (33) adjusts the pressure reduction value of solenoid proportional pressure reducing valve 26, and thereby decreases the pilot pressure sent to directional control valve (3) via pilot line (17). Specifically, the solenoid proportional pressure reducing valve 26 of this embodiment (solenoid proportional pressure reducing valve 27 is the same) is set up such that, as is shown in FIG. 5, the pressure reduction value (secondary pressure) to be applied to the pilot pressure Pa (primary pressure), which is set by the pilot pressure generation means of control device (6) in accordance with the degree of operation, R of the operating lever, decreases as the level of the command signal (voltage signal) I from the outflow restriction control component (33) increases. Also when pressure $P_1$ reaches the critical pressure, $P_c$, the outflow restriction control component (33) increases the level of the present command signal (voltage signal), I, (starting condition, I=0) by a predetermined amount (delta) I, and does this every time it attains that pressure $P_1$ has reached critical pressure $P_c$. In this way, the pilot pressure actually sent to the directional control valve (3) is smaller than the pilot pressure, $P_a$, and the restriction area of the outflow variable restriction of the directional control valve (3) decreases.

As a result, the resistance to the flow of fluid out of the hydraulic cylinder (1) increases and it becomes difficult for the amount of fluid flowing out of the hydraulic cylinder to increase and hence sudden drops in the fluid pressure of the inlet side fluid chamber (bottom fluid chamber), $P_1$, can be controlled (prevented) and cavitation and conditions which lead to unstable cylinder operation can be avoided. The same kind of operation is carried out for the case when the directional control valve is in position C.

Thus, in the hydraulic device of this embodiment, it is possible to achieve a cylinder operation which is stable and which is in accordance with the degree of operation, R of the operating lever and it is also possible to prevent the occurrence of cavitation caused by sudden changes in load. Furthermore, because the controller 28 only acts to decrease the constriction area of outlet side variable restriction (15) of the directional control valve (3) in cases when the fluid pressure in the inlet side fluid chamber of the hydraulic cylinder, $P_1$, falls below a critical pressure i.e. when there is the fear that cavitation may occur, there is no unnecessary constriction of the passage on the outflow side of the hydraulic cylinder and accordingly it is possible to operate the hydraulic cylinder efficiently in times of normal operation.

Second Embodiment

Next, a second preferred embodiment of the present invention shall be described with reference to FIGS. 7 to 10.

The hydraulic device of this embodiment has the same basic structure as the hydraulic device shown in FIG. 1, and therefore in describing this second embodiment the same reference numbers shall be used and a detailed explanation omitted for those parts which are identical to those in FIG. 1.

Figure 7:
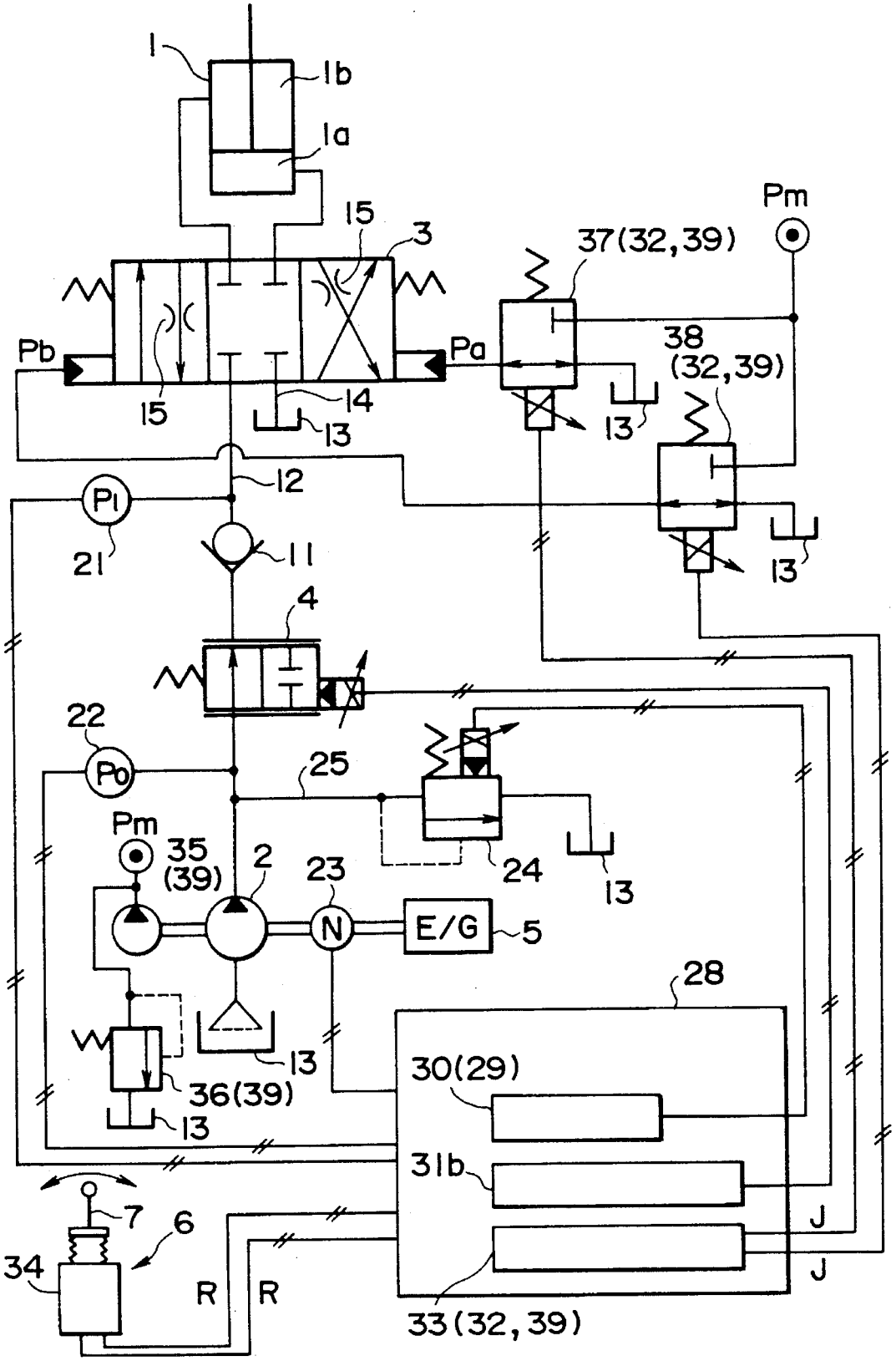
FIG. 7 shows the construction of a hydraulic device according to a second embodiment of the present invention.

With reference to FIG. 7, in the hydraulic device of this embodiment, the structure by which fluid flows from hydraulic pump (2) to inlet side fluid chamber (1 *a*) or (1*b*) of hydraulic cylinder (1) via solenoid proportional flow control valve (4) and directional control valve (3), and by which fluid flows from the outlet side fluid chamber (1*a*) or (1*b*) to the fluid tank (13) via directional control valve (3) is identical to that shown in FIG. 1.

However, in the hydraulic device of this embodiment, the method of the switching of the directional control valve is different to that of the hydraulic device shown in FIG. 1. Control device (6) which carries out the switching operation of the directional control valve (3) comprises an operating lever (7) movable backwards and forwards, and a degree of operation detection unit (34) which detects the degree of operation of said operating lever (7) electrically by a potentiometer etc. (not shown). Then, in the same way as in the hydraulic device shown in FIG. 1, the degree of operation, R, detected by degree of operation detection unit (34), is taken up by controller (28) which in terms of functional components is comprised of pressure difference control component (30), inflow restriction control component (31*b*) and outflow restriction control component (33). Further, pilot pressures $P_a$ and $P_b$ for switching the directional control valve (3) from a middle position A to position B side or position C side are generated through the reduction in pressure of a basic pressure, $P_m$ (generated by a secondary pump), by means of solenoid proportional pressure reducing valves (37) and (38).

The outflow restriction control component (33) and solenoid proportional pressure reducing valves (37,38) of controller (28) do as mentioned later comprise outflow restriction control means (32) as well as comprise secondary pump (35) and unloading valve 36 together with direction switching drive means (39) which sends pilot pressures $P_a$, $P_b$ (corresponding to the degree of operation, R of the operating lever (7)) to directional control valve (3) to perform the switching operation of the directional control valve (3). The outflow restriction control component (33) sends a command signal, J of a level proportional to that of the degree of operation, R, of the operating lever detected by degree of operation detecting unit (34) (See FIG. 8) to solenoid proportional pressure reducing valve (37) or (38). Then, the solenoid proportional pressure reducing valve generates from basic pressure, $P_m$, pilot pressures $P_a$ and $P_b$ in proportion to the command signal J sent from the outflow restriction control component (33). The characteristic of the restriction area of the inlet and outlet passages of the directional control valve with respect to the level of the command signal, J, is as shown in FIG. 9. Namely, the restriction area of the inflow passage of directional control valve (3) quickly becomes fully open as the level of the command signal J increases with an increase in the degree of operation, R of the operating lever (7), whereas the opening area of the outflow passage of the directional control valve (3) increases in proportion to an increase in the level of command signal J with the increase in the degree of operation of the operating lever (7). This characteristic is substantially the same as that characteristic shown in FIG. 2.

Figure 8:
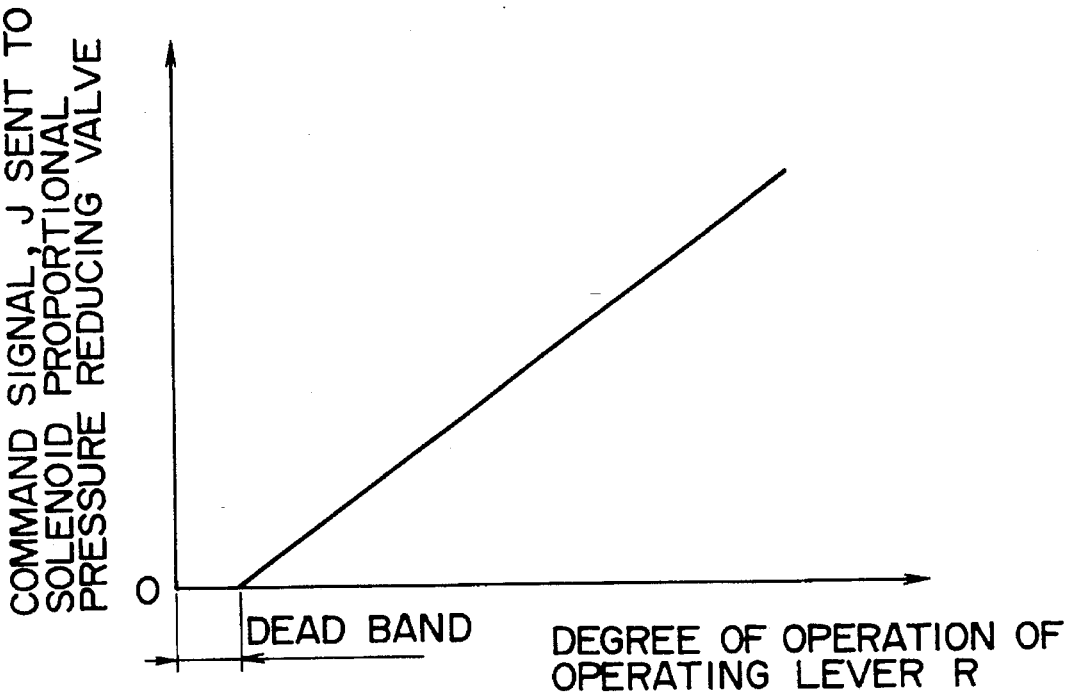
FIG. 8 is a diagram explaining the operation of the hydraulic device shown in FIG. 7.
Figure 9:
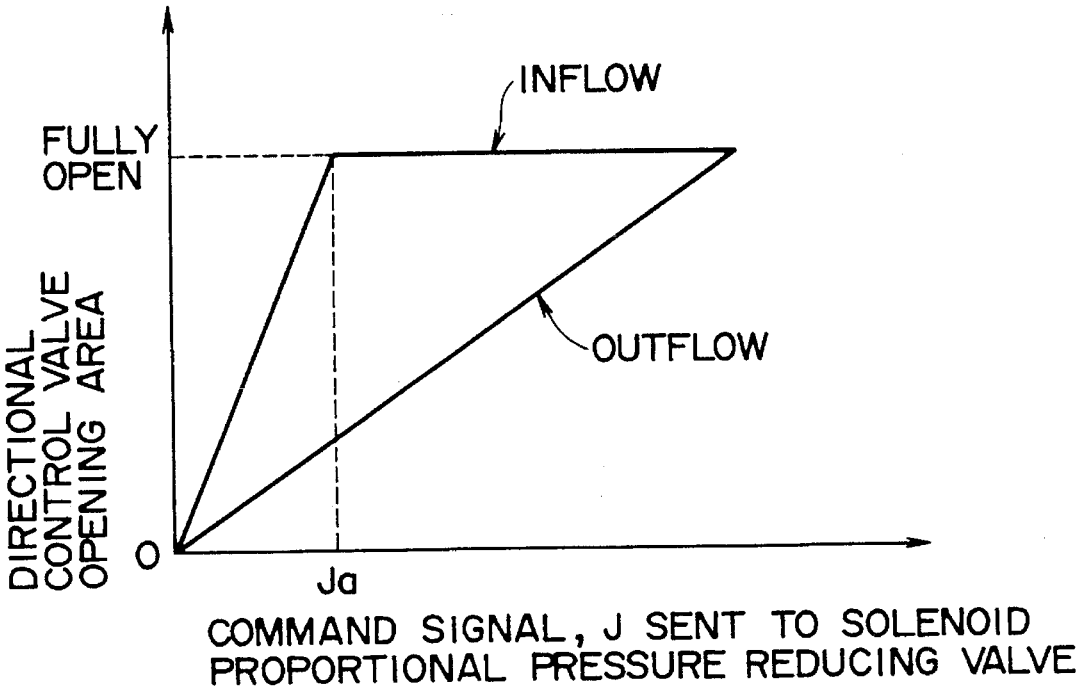
FIG. 9 is a diagram explaining the operation of the hydraulic device shown in FIG. 7.
Figure 10:
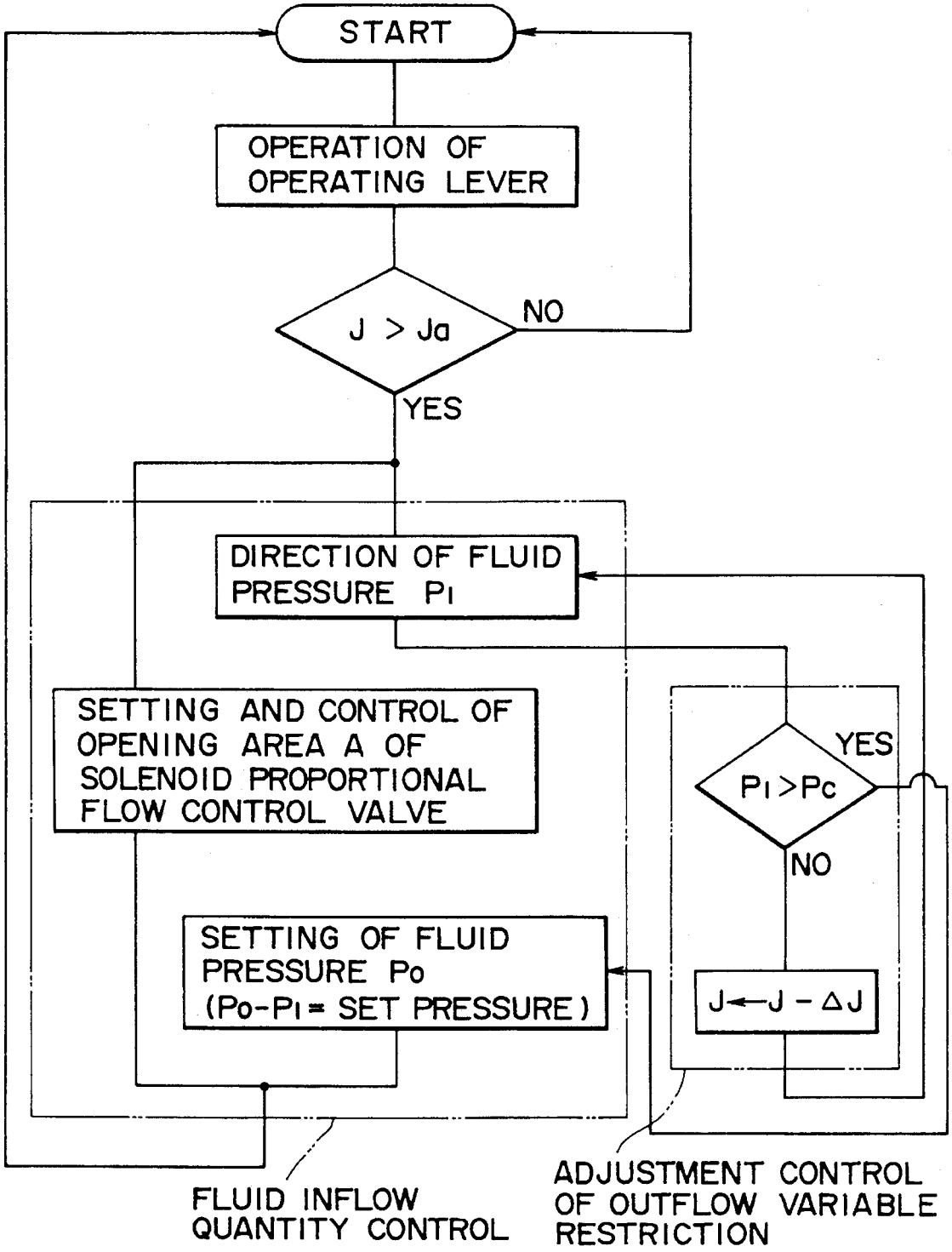
FIG. 10 is a flowchart explaining the operation of the hydraulic device shown in FIG. 7.

With reference to FIGS. 7 and 10, in this hydraulic device, when the operator moves the operating lever (7) forwards from a center position for example, the outflow restriction control component 33 of the controller 28 sets the level of a command signal to be sent to solenoid proportional pressure reducing valve 37, in accordance with the degree of operation, R of the operating lever detected by degree of operation detecting unit 38, in the way shown in FIG. 8, and that command signal, J, is sent to solenoid proportional pressure reducing valve 37. In this way, a pilot pressure $P_a$, created by the reduction in pressure of a basic pressure $P_m$ by the solenoid proportional pressure reducing valve 37, and in accordance with the degree of operation of the operating lever, is sent to directional control valve (3) and the directional control valve is switched from position A to position B side.

Then, if after operation begins, the level of command signal J, reaches a level $J_a$ at which the inlet passage of the directional control valve in position B becomes fully open (See FIG. 9), control is performed by controller 28 in the same way as that in the previous embodiment.

Namely, for the hydraulic fluid on the inlet side of the hydraulic cylinder, the pressure difference between the pressures on the inlet and outlet sides of the solenoid proportional flow control valve (4) is controlled to be a preset pressure difference through means of the solenoid proportional unloading valve (24), and an opening area corresponding to the degree of operation, R is controlled according to the characteristic of the opening area, A of solenoid proportional flow control valve (4) against load pressure $P_1$ and engine rotation speed, N. In this way, it is basically possible to ensure that the quantity of fluid, Q flowing into the hydraulic cylinder (5) corresponds to the degree of operation, R of the operating lever.

However, if during operation of the hydraulic cylinder, the fluid pressure in the inlet fluid chamber of the hydraulic cylinder falls as far as the previously described critical pressure $P_c$, then as shown in FIG. 10, the outflow restriction control component (33) of the controller (28) reduces the level of the present command signal to be sent to solenoid proportional pressure reducing valve (37) by a predetermined amount (delta J), and repeats this action at predetermined intervals of time until pressure $P_1$ goes above critical pressure $P_c$.

Thereby, the pilot pressure, $P_a$ actually sent to directional control valve (3) is reduced and accordingly the restriction area of the outflow variable restriction (15) is reduced. As a result, any sudden drops in the fluid pressure of the inlet side chamber of the hydraulic cylinder (5) (i.e. bottom side fluid chamber) are controlled and cavitation and the kind of conditions which lead to unstable cylinder operation are avoided.

Therefore, in the hydraulic device of this embodiment too, it is possible to achieve a cylinder operation which is stable and which is in accordance with the degree of operation, R of the operating lever and it is also possible to prevent the occurrence of cavitation caused by sudden changes in load. For each of the embodiments described above, we have described a set-up where the outflow variable restriction is installed as part of the directional control valve (3), but it can obviously also be installed separate from the directional valve (3), for example in the fluid line (14) of FIG. 1. In that case the outflow variable restriction could comprise a slow-return valve, solenoid proportional flow control valve or the like. However, by installing the outlet side variable restriction as part of the directional control valve (3) as in this embodiment, it is possible to reduce the number of components of the hydraulic device as well as simplify the set-up of the device. Also, it will be obvious to one skilled in the art that when the outflow variable restriction is installed separate of the directional control valve, it is possible to incorporate the inflow variable restriction as part of the directional control valve. Furthermore although in this embodiment, the switching of the direction of the fluid through the hydraulic cylinder (5) has been performed by a directional control valve (3), it is also possible to employ a logic valve as shall be described later for the third and fourth embodiments.

Third Embodiment

Next, the third embodiment of the present invention shall be described with reference to FIGS. 11 to 15.

Figure 11:
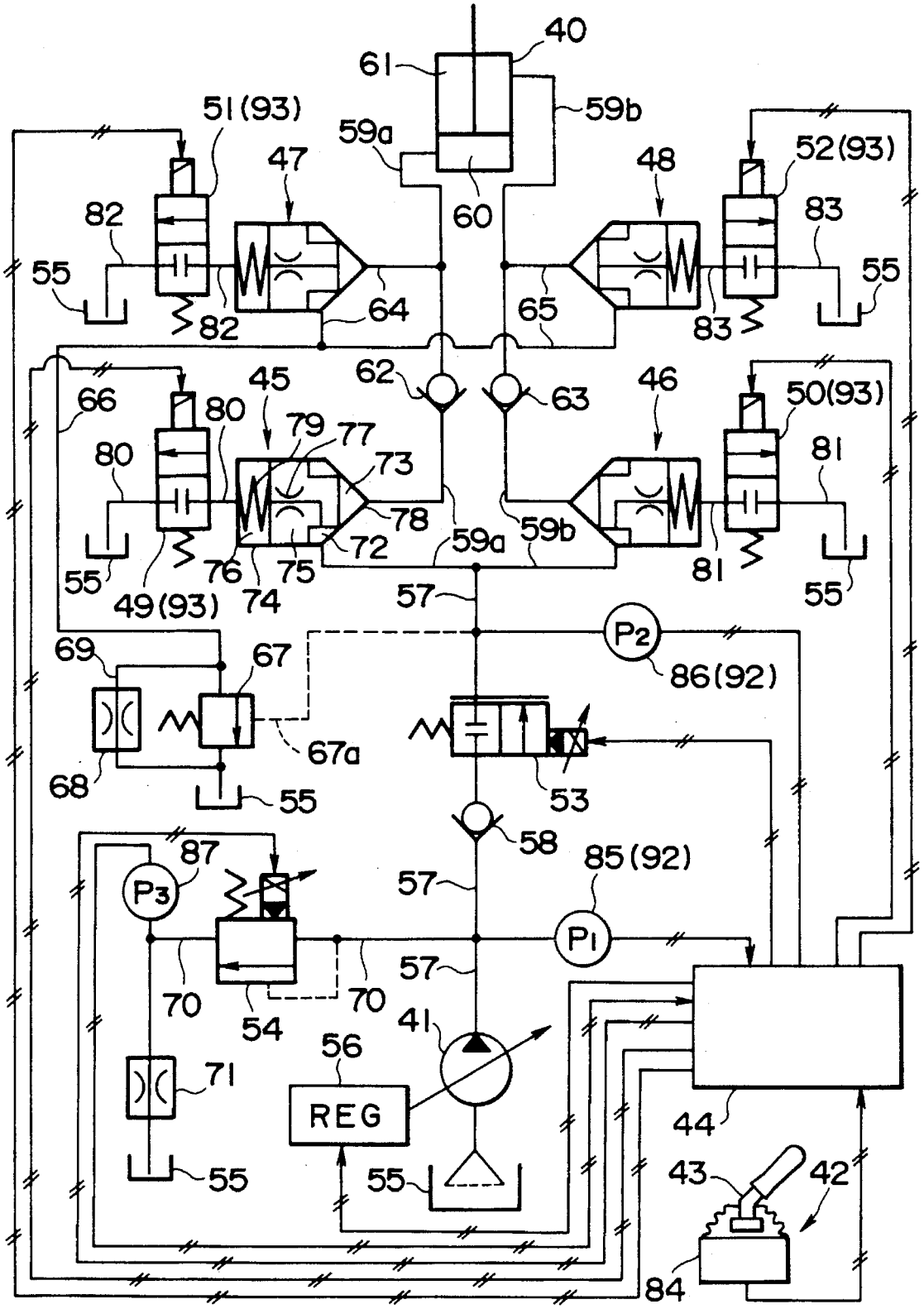
FIG. 11 shows the construction of a hydraulic device according to a third embodiment of the present invention.

With reference to FIG. 11, this embodiment is installed for example in a hydraulic shovel. It comprises a hydraulic cylinder (actuator) (40) for driving the arm of a hydraulic shovel or the like; a hydraulic pump (41) as a drive source for the hydraulic cylinder (40); a control device (42) comprising an operating lever (43) by which the operator controls the operation of the hydraulic cylinder (40); a controller (44) comprising a microcomputer or the like comprising an electronic circuit (not shown in the Figures); logic valves (45), (46), (47) and (48) as operation direction switching means for switching the direction of flow of fluid through the hydraulic cylinder (40); solenoid switching valves (49), (50), (51) and (52) for respectively driving logic valves (45), (46), (47) and (48); solenoid proportional flow control valve (inflow variable restriction) (53) for controlling the amount of fluid flowing to hydraulic cylinder (40); pressure compensator type solenoid proportional unloading valve (54) for controlling the fluid pressure on the inlet side of solenoid proportional flow control valve (53); and fluid tank (55) for storing the fluid to be sucked and discharged by hydraulic pump (41).

Hydraulic pump (41) is a variable capacity type pump whose capacity can be controlled by a regulator (56). Said pump is driven by the engine (not shown) of the hydraulic shovel and sucks and discharges fluid held inside fluid tank (55).

In the pump-side fluid line (57) leading from the output port of the hydraulic pump (41), there is installed a check valve (58) and the solenoid proportional flow control valve (53) in that order from the upstream side, and on the downstream side of solenoid proportional flow control valve (53) there are a pair of actuator side fluid lines (59*a*) and (59*b*) branching off from said pump-side fluid line (57) and which are respectively connected to the bottom side fluid chamber 60 and rod side fluid chamber 61 of the hydraulic cylinder (40). Inlet side logic valves (45) and (46) and check valves (62) and (63) are respectively installed in actuator fluid side lines (59*a*) and (59*b*) in that order from the solenoid proportional flow control valve (53). Also, on the downstream side of check valves (62) and (63), exit lines (64) and (65) lead from actuator side fluid lines (59*a*) and (59*b*) respectively and outflow side logic valves (49) and (50) are respectively installed in exit lines (64) and (65). Exit lines (64) and (65) join exit line (66) leading to fluid tank (55) on the downstream side of outflow logic valves (47 and 48).

In exit line (66) there is installed a counterbalance valve (67) comprising a flow control valve having a outflow variable restriction, and in parallel with counterbalance valve (67) a bypass line (69) having a restriction 68 of small restriction area is installed. The restriction area of counterbalance valve (67) changes in accordance with a pilot pressure, and as for example shown in FIG. 14, usually it is held firmly closed but its restriction area increases in accordance with an increase in the pilot pressure. On the downstream side of solenoid proportional flow control valve (53), a pilot line (67*a*) leading from the pump side line (57) is connected to counterbalance valve (67). Pilot line (67*a*) comprises outflow restriction control means and takes the pressure on the inflow side of solenoid proportional flow control valve (53) (under usual cylinder operation this is equal to the load pressure on the hydraulic cylinder) as a pilot pressure and sends this pilot pressure to counterbalance valve (67).

Also, there is a fluid line (70) leading from the fluid line (57) between the hydraulic pump (41) and the check valve (58) and this line (70) is used to return excess fluid expelled from said hydraulic pump (41) back to said fluid tank (55). Solenoid proportional unloading valve (54) is installed in said fluid line (70) and a restriction (71) is installed on the downstream side of this solenoid proportional unloading valve (54).

Since the structure of each logic valve (45), (46), (47) and (48) is fundamentally the same, only the structure of logic valve (45) shall now be described. Logic valve (45) comprises a sleeve (74) having at its end sections an inlet port (72) and outlet port (73) respectively connected to the upstream side and downstream sides of actuator side fluid line (59*a*); a poppet valve (75) slideably movable within said sleeve (74); a pilot fluid chamber (76) located at the rear portion of sleeve (74); and a restriction line (77) formed within the popper valve (75) and connected to the pilot fluid chamber (76) and inlet port (72). When the poppet valve (75) is slid to a forward end position it contacts a valve seat (78) formed at the end section of said sleeve (74), the connection between inlet port (72) and outlet port (73) is broken and fluid line (59*a*) is closed, and when it is slid to a back end position it is out of contact with the valve seat (78) and inlet port (72) and outlet port (73) are connected and the fluid line (59*a*) is opened. Poppet valve is held firmly against the valve seat (78) (i.e. in a closed position) by a spring (79) located in pilot fluid chamber (76). The other logic valves (46), (47) and (48) also have the same kind of structure.

For the logic valves (45), (46), (47) and (48), if the pilot fluid chamber (76) is opened, one part of the fluid flowing into the inlet port (72) flows through restriction line (77) into pilot fluid chamber (76) and as a result, the pilot pressure on the inlet port (72) side becomes greater than the pilot pressure in the pilot fluid chamber (76). Consequently, the popper valve (75) resists the restoring force of spring (79) and slides out of contact with the valve seat (78) and inlet port (72) and outlet port (73) become connected and the valve is opened. If pilot fluid chamber (76) is closed off, the poppet valve (75) is held in contact in with the valve seat (78) by the restoring force of the spring (79) and the valve is closed, and since there is no pressure difference between the pilot fluid chamber and the inlet port (72) side, and because the area of the pilot fluid chamber (76) of poppet valve (75) is greater than that of the area of the inlet port (72) side, a force acts to push the poppet valve against the valve seat (78) and the valve is maintained in a closed position.

With these kind of logic valves (45), (46), (47) and (48), it is generally possible to handle large volumes and large pressures With small scale structures. Furthermore, leaks of hydraulic fluid from such valves are extremely small and also a large operating power is not required for opening and closing the valve because a power capable of opening up and closing off said pilot fluid chamber is sufficient.

Pilot lines (80), (81), (82) and (83) each leading to the fluid tank (55) are connected to the pilot fluid chamber (76) of logic valves (45), (46), (47) and (48) respectively and solenoid switching valves (49), (50), (51) and (52) are installed in these pilot lines (80), (81), (82) and (83). Said solenoid switching valves (49), (50), (51) and (52) are two-position switch valves switchable between a closed position, wherein said pilot lines (80), (81), (82) and (83) are closed and an open position wherein said pilot lines (80), (81), (82) and (83) are open. When in the closed position, the pilot fluid chambers of logic valves (45), (46), (47) and (48) are closed off and when in the open position, the pilot fluid chambers of logic valves (45), (46), (47) and (48) are opened up to the fluid tank (55).

For example, suppose the operating lever (43) of control device (42) is movable backwards and forwards and the operator moves the operating lever forwards when he wants to extend hydraulic cylinder (40) and moves it backwards when he wants to contract hydraulic cylinder (40). Control device (42) comprises a degree of operation detection unit (84) which through a potentiometer etc. detects the direction and degree of operation of the operation of the operating lever (43). This degree of operation detection unit (84) produces a detection signal (electric signal) whose polarity corresponds to the direction of operation of the operating lever (43) and whose level is in proportion to the degree of operation of the operating lever (43). In the region of a center lever position, a dead band is established and when the operating lever is within this region, the level of the signal to be output from the degree of operation detection unit (84) is level zero. Furthermore, there is a pressure sensor (85) located in the pump side fluid line (57) between the hydraulic pump (41) and the check valve (58) for detecting the pressure $P_1$ on the inlet side of solenoid proportional flow control valve (53) and a pressure sensor (86) located in the pump side fluid line (57) downstream of solenoid proportional flow control valve (53) for detecting the pressure $P_2$ on the outlet side of solenoid proportional flow control valve (53). Also, there is a pressure sensor (87) located in fluid line (70) for detecting the pressure, $P_3$ between the unloading valve (54) and the restriction (71). Because the restriction (71) is fixed, the pressure $P_3$ detected by pressure sensor (87) corresponds to the amount of excess hydraulic fluid flowing through line (70).

Figure 12:
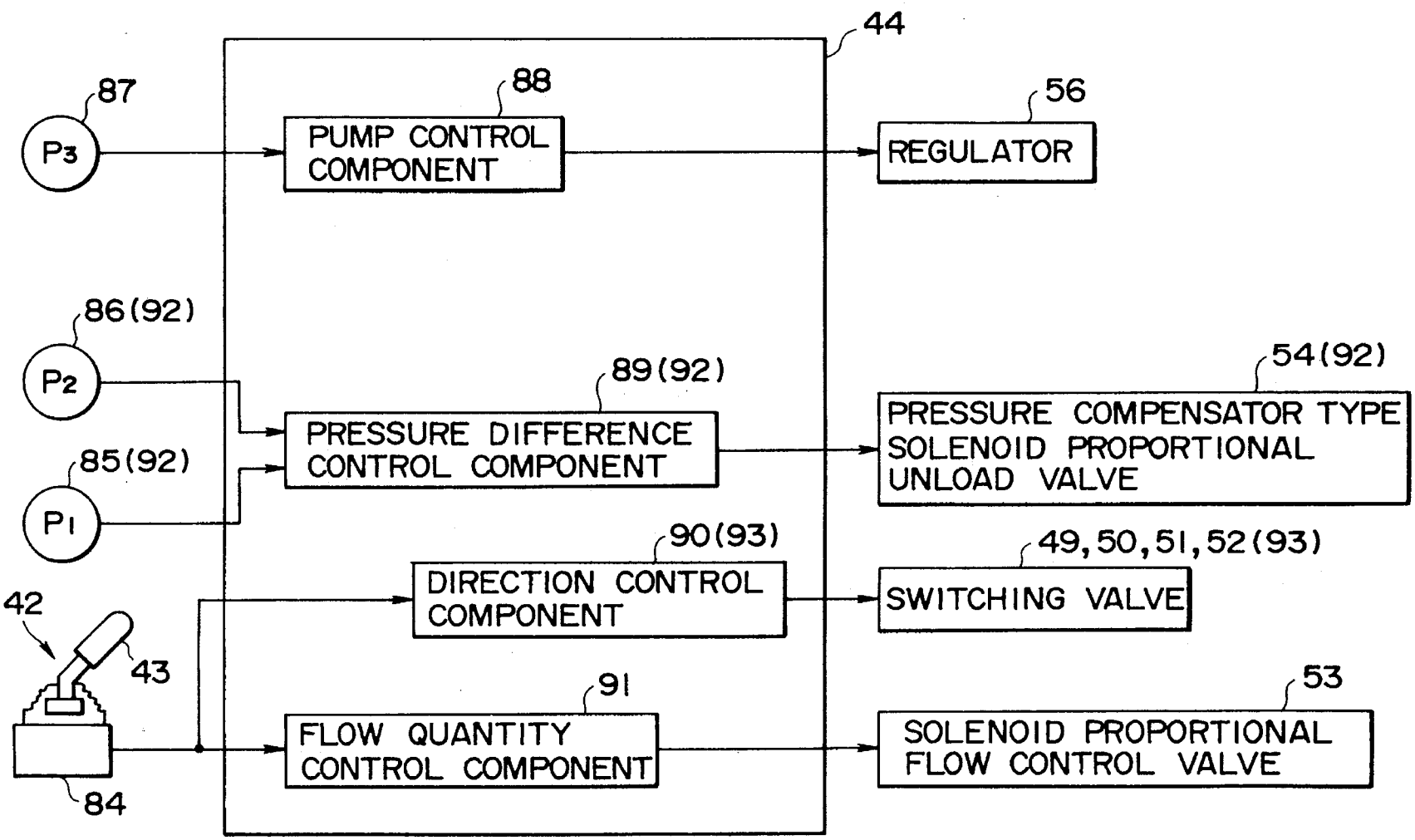
FIG. 12 is a block diagram showing the essential components of the hydraulic device shown in FIG. 11.
Figure 13:
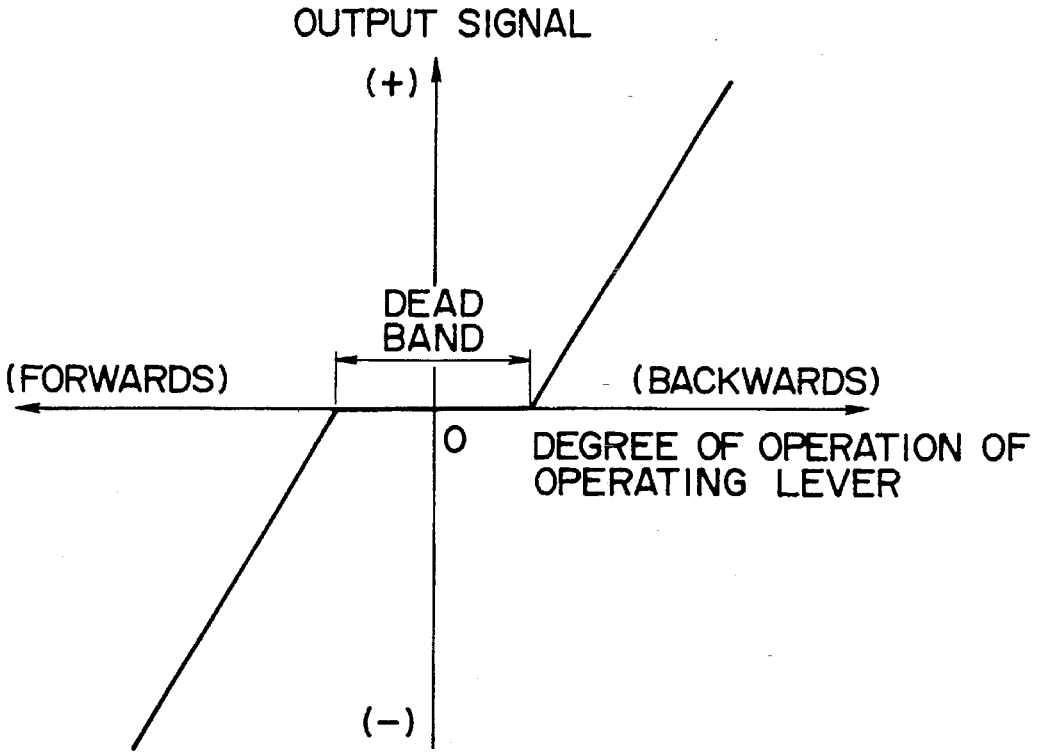
FIG. 13 is a diagram explaining the operation of the hydraulic device shown in FIG. 11.

With reference to FIG. 12, the controller (44) is comprised in terms of functional components of the following: pump control component (88) which through means of regulator (56) controls the capacity of the hydraulic pump (41) i.e. the amount of fluid expelled by the hydraulic pump, in accordance with the pressure $P_3$ detected by pressure sensor (87); pressure difference control component (89) which monitors pressure $P_1$ through means of pressure sensor (85) controls the set pressure of solenoid proportional unloading valve (54) in accordance with the pressure $P_2$ detected through means of pressure sensor (86); operation direction control component (90) which attains the direction of operation of the operating lever (43) through the polarity of the command signal (See FIG. 13) produced by degree of operation detection unit (84) and accordingly controls the drive of solenoid switching valves (49), (50), (51 ) and (52); and flow control component (91) which attains the degree of operation of the operating lever (43) through the level of the command signal produced by the degree of operation detection unit (84) and accordingly controls the opening area of solenoid proportional flow control valve (53).

Next, the operation of the device of this embodiment shall be described.

For example consider the case when the hydraulic cylinder (40) is to be extended. Then the hydraulic pump is activated and the operating lever is moved forwards. Then if the lever is moved forwards out of the dead band (See FIG. 13), a command signal having a polarity corresponding to the direction of operation of the operating lever (43) and a level in proportion to the degree of operation of the operating lever is produced by degree of operation detection unit (84) of control device (42) and sent to controller (44). Then, the operation direction control component (90) of controller (44) attains through the polarity of the command signal that the operating lever has been moved forwards and hence that an extension operation is desired. Accordingly, it sends an electric signal to the solenoids of solenoid switching valves (49) and (52) to drive the solenoid switching valves (49) and (52) into an open position.

In this way, the pilot fluid chambers (76) of logic valves (45) and (48) are opened up to the fluid tank (55) through pilot lines (80) and (83) and logic valves (45) and (48) are opened. The solenoid switching valves (50) and (51) are held in a closed position and hence the logic valves (46) and (47) are held closed.

Also, in parallel with the opening of logic valves (45) and (48), the pressure difference control component (89) of the controller (44) to the pressure $P_1$ detected by pressure sensor (86) (the load pressure on the actuator) sends a command to the solenoid proportional unloading valve (54) such that the pressure $P_2$ detected by pressure sensor becomes greater than pressure $P_1$ by a predetermined pressure difference i.e. it instructs the solenoid proportional unloading valve (54) to adopt as the set pressure value a pressure calculated by adding the set pressure difference to pressure $P_2$ detected by pressure sensor (86). Thereby, the pressure difference ($P_2$–$P_1$) between the upstream side and the downstream side of the solenoid proportional flow control valve (53) is maintained at uniform pressure difference irrespective of the value of the load pressure on the hydraulic cylinder.

Furthermore, in parallel with the above described operation, the flow control component (91) of controller (44) attains the degree of operation of the operating lever (43) through the level of the detection signal sent from the degree of operation detection unit, and sends a command signal having a level in proportion to the degree of operation of the operating lever (43) to solenoid proportional flow control valve (53). Then, the solenoid proportional flow control valve (53) opens to an opening area proportional to that of the level of the command signal sent from the controller and hence proportional to the degree of operation of the operating lever.

Figure 14:
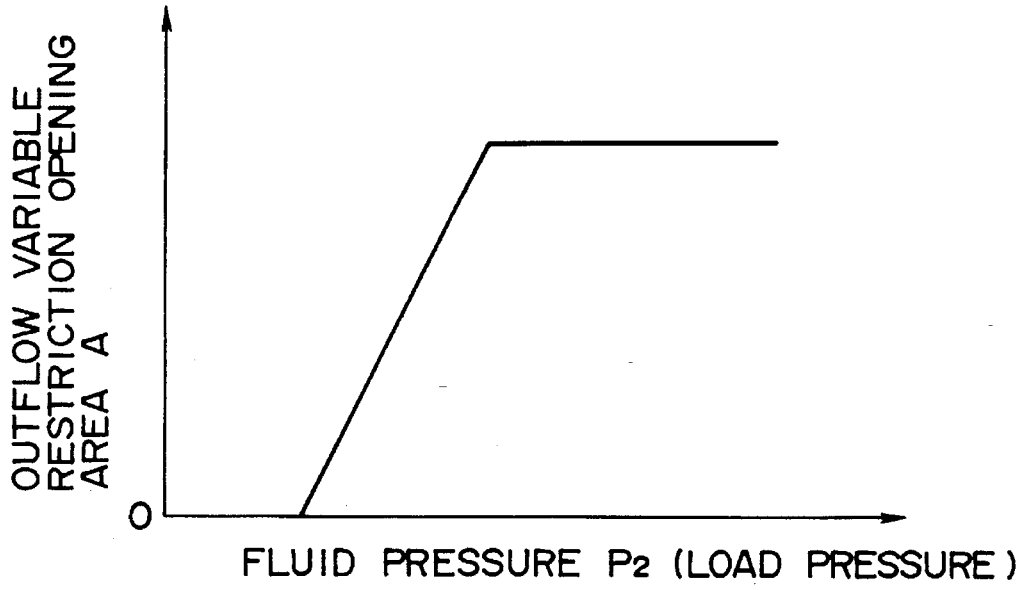
FIG. 14 is a diagram explaining the operation of the hydraulic device shown in FIG. 11.
Figure 15:
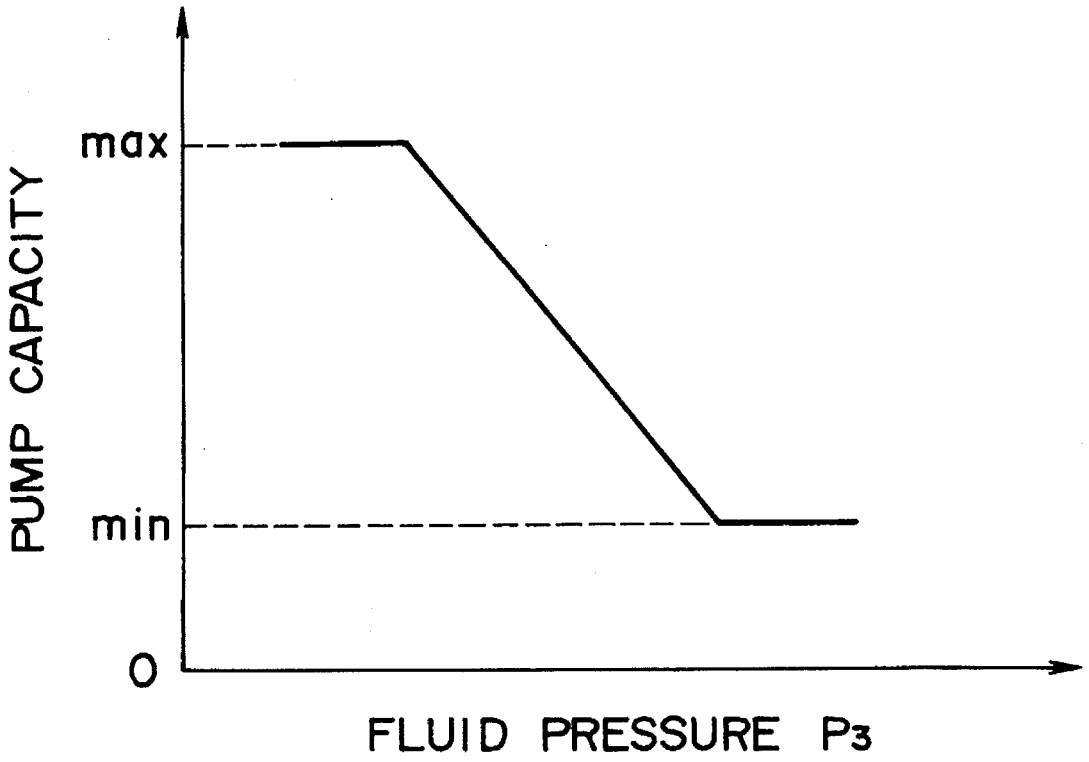
FIG. 15 is a diagram explaining the operation of the hydraulic device shown in FIG. 11.

Also, when as described above the logic valves (45) and (48) are open, the pressure on the outlet side of the solenoid proportional flow control valve (53), $P_2$ (i.e. the pressure load on the hydraulic cylinder) is taken as a pilot pressure and and sent to counterbalance valve (67) via pilot line (**67*a*), and counterbalance valve (67) opens to an opening area corresponding to that pilot pressure (See FIG. 14**).

Thereby, hydraulic fluid expelled by the hydraulic pump (41), is supplied to the bottom side fluid chamber of hydraulic cylinder (40) via pump side fluid line (57) and actuator side fluid line (**59*a*), and is returned from the rod-side fluid chamber of the hydraulic cylinder (40) to the fluid tank (55) via actuator side fluid line (59*b*), exit lines (65) and (66), and counterbalance valve (67). Thus the hydraulic cylinder is extended. During operation of the hydraulic cylinder (41), there are cases when the counterbalance valve is closed (due to for example delays in response time of the counterbalance valve). In such cases, the hydraulic fluid in the rod side fluid chamber of the hydraulic cylinder flows out through by-pass line (68) having a restriction (68) installed in parallel with the counterbalance valve (67). Then, since the restriction area of this restriction (68**) has been made sufficiently small, conditions of the type in which the hydraulic cylinder suddenly starts to operate can be avoided.

Since during the above described operation of the hydraulic cylinder (40), the pressure difference ($P_2$–$P_1$) between the inlet side and outlet side of the solenoid proportional flow control valve (53) is maintained at a constant pressure difference, the amount of fluid flowing through the solenoid proportional flow control valve (53) i.e. the amount of fluid supplied to the hydraulic cylinder (40) is in proportion to the opening area of the solenoid proportional flow control valve (53) irrespective of the pressure load on the hydraulic cylinder, and since the opening area of the solenoid proportional flow control valve (53) is in proportion to the degree of operation of the operating lever, the amount of fluid supplied to the hydraulic cylinder is in proportion to the degree of operation of the operating lever. Accordingly, irrespective of the size of or changes in the load on the cylinder, an amount of fluid in proportion to the degree of operation of the operating lever is supplied to the hydraulic cylinder and the cylinder is extended at a speed corresponding to the degree of operation of the operating lever.

Also, if a load pressure acting in a direction opposite to that of the direction of operation of the hydraulic cylinder changes, for example if the load pressure increases, then the restriction area of the counterbalance valve increases and the outflow resistance to fluid on the outlet side of the hydraulic cylinder (40) decreases and as a result an amount of fluid corresponding to the amount of fluid on the inlet side of the hydraulic cylinder flows out through counterbalance valve (67) and hence a stable operation speed corresponding to the degree of operation of the operating lever can be achieved.

On the other hand, if for the above operation, the restriction area of the counterbalance valve (67) becomes relatively large corresponding to a condition when the load pressure on the hydraulic cylinder (40) is relatively large, and for example a load acting on the hydraulic cylinder in a direction opposite to that of the direction of operation of the cylinder then reverses to act in the same direction as the direction of operation of the hydraulic cylinder (40), then the pressure in the inlet side fluid chamber (bottom side fluid chamber) (60) of the hydraulic cylinder (40), $P_2$ suddenly drops. However when pressure $P_2$ drops, since the pilot pressure sent to the counterbalance valve (67) also drops, the restriction area of the counterbalance valve (67) suddenly decreases. As a result, the resistance to fluid flowing out of the hydraulic cylinder (40) suddenly increases and thus the sudden decrease in pressure $P_2$ is controlled and the occurrence of cavitation avoided.

The above kind of operation is performed in a similar way if the operating lever (43) is moved backwards in order to contract the cylinder. In this case, logic valves (46) and (47) are opened and logic valves (45) and (48) are closed.

When the operating lever is held in a central position within the dead band, all the solenoid switching valves (49), (50), (51) and (52) are held in a closed position, the logic valves (45), (46), (47) and (48) are held in a closed position and the solenoid proportional flow control valve (53) is held closed. Thus both fluid chambers (60) and (61) of the hydraulic cylinder (40) are blocked and the hydraulic cylinder (40) is held in a hold position.

In the previously described kind of operation, the pump control component (88) of the controller (44) attains the amount of fluid flowing through fluid line (70) (excess fluid) through the pressure $P_3$ detected by pressure sensor (87) and as shown in FIG. 3 controls the capacity of the pump (amount of fluid expelled from pump) within a range between a maximum capacity and a minimum capacity in accordance with the pressure $P_3$. In other words, since due to restriction (71) the pressure $P_3$ increases the greater the amount of excess fluid flowing through fluid line (70), the pump control component (88) of the controller (44) decreases the pump capacity by means of regulator (56) in proportion to the increase in $P_3$. Thereby, it is possible to operate the hydraulic cylinder (41) using only that amount of fluid necessary for the operation of the hydraulic cylinder (41).

It is to be noted that the capacity of the hydraulic pump can also be controlled in accordance with the degree of operation of the operating lever.

Also, since logic valves, which are small in size but can operate at large volumes and pressures and which are driven by only a small operating power, are employed for the switching of the direction of operation of the hydraulic cylinder (40) in the hydraulic device of this embodiment, the device can be made into a relatively small and simple structure and the cost can be reduced. Also because the leakage volumes of logic valves (45), (46), (47) and (48) are extremely small when in a closed position, the hydraulic cylinder can be driven at a high efficiency and also when the operating lever is held in a center position it is possible to reliably maintain the hydraulic cylinder in a hold position.

Fourth Embodiment

Figure 16:
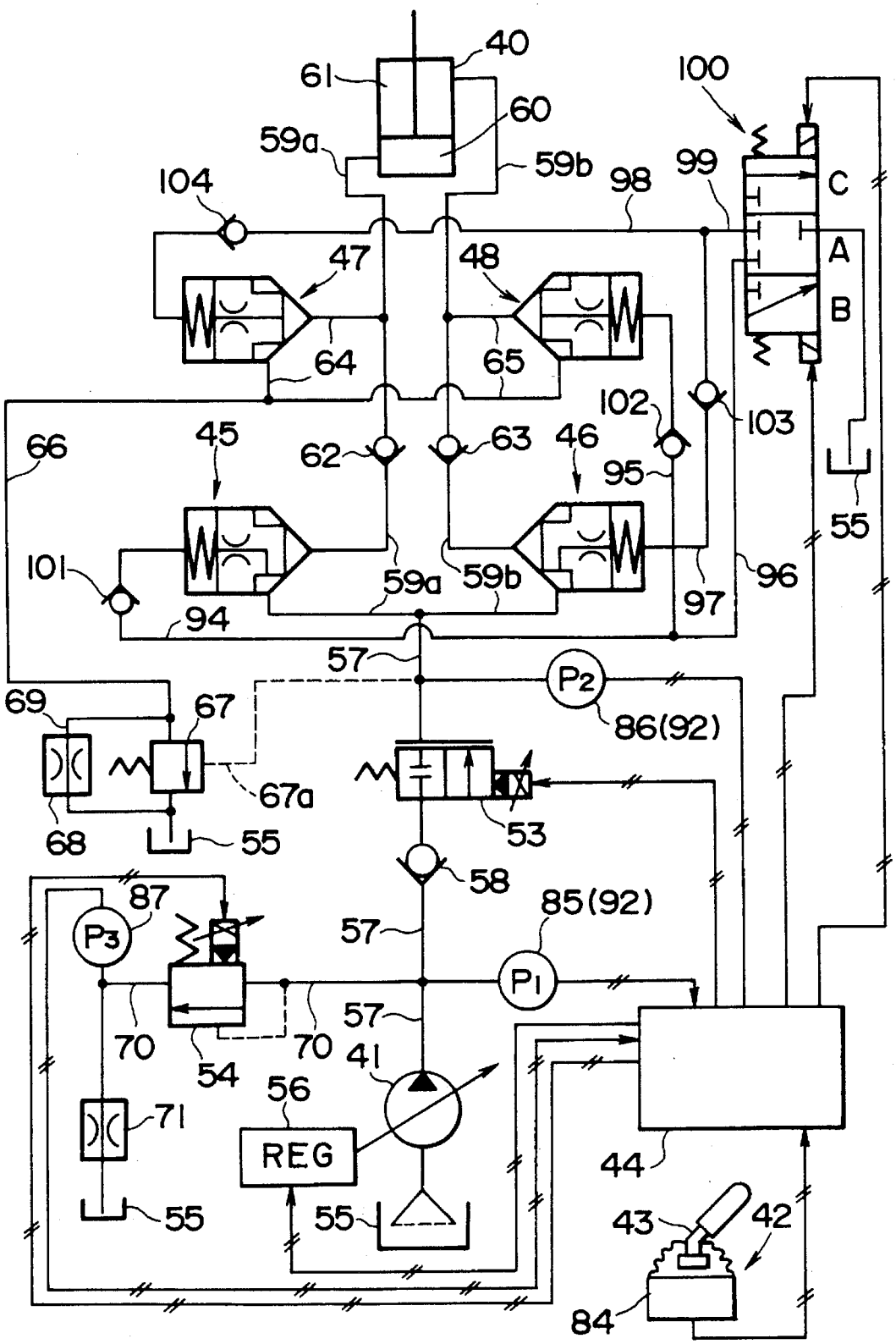
FIG. 16 shows the construction of a hydraulic device according to a fourth embodiment of the present invention.

Next, a hydraulic device for a construction machine according to a fourth embodiment shall be described with reference to FIG. 16. The device of this embodiment has the same basic structure as the device of the third embodiment described previously, and therefore in describing this fourth embodiment, the same reference numbers shall be used for those parts which are identical to those of the third embodiment and a detailed explanation is omitted for those parts.

The hydraulic device of this embodiment has the same basic structure as the device shown in FIG. 11. It only differs from the device of FIG. 11 in the respect that the structure of the direction switching drive means used to drive the opening and closing of the logic valves (45), (46), (47) and (48) is different.

The device of this embodiment comprises pilot line (96) to which pilot lines (94 and (95), which lead from the pilot fluid chambers (76) of logic valves (45) and (48) respectively are joined; and pilot line (99) to which pilot lines (97 and (98), which lead from the pilot fluid chambers (76) of logic valves (46) and (47) respectively are joined. In between these pilot lines (96) and (99), and fluid tank (55) there is installed a three position solenoid switching valve (100) which comprises the direction switching drive means (93). This solenoid switching valve (100) is switchable between a position A in which both pilot lines (96) and (99) are cut off from fluid tank (55); a position B in which pilot line (96) is opened up to fluid tank (55) but pilot line (99) is cut off from fluid tank (55); and a position C in which pilot line (96) is cut off from fluid tank (55) but pilot line (99) is opened up to fluid tank (55). Also in lines (94), (95), (97) and (98) there are respectively installed check valves (101), (102), (103) and (104) for preventing the flow of fluid through lines (94), (95), (97) and (98) when the solenoid switching valve (100) is in position A (central position).

In this device, when the hydraulic cylinder (40) is to be extended, the controller (44) sends an electric signal to the solenoid of the B position of the solenoid switching valve (100) and the solenoid switching valve (100) is switched to position B. Thus, only pilot line (96) is opened up to the fluid tank (55), in other words only the pilot fluid chambers (76) of logic valves (45) and (48) are opened and hence only logic valves (45) and (48) are opened. Then in parallel with this, and in the same way as in the previously described embodiments, the opening area of solenoid proportional flow control valve (53) and the pressure difference ($P_1$–$P_2$) between the inlet side and outlet side of the solenoid proportional flow control valve (53) are controlled and thus the cylinder is extended at a operation speed corresponding to the degree of operation of the operating lever. Also, the restriction area of counterbalance valve (67) on the outlet side of the hydraulic cylinder (40) varies in accordance with the pressure load, $P_2$ on the hydraulic cylinder (40).

When the hydraulic cylinder (40) is to be contracted, the solenoid switching valve (100) is switched to position C and operation is performed in a similar way to the case of cylinder extension. The device of this embodiment has the same effect as the device of the third embodiment, and since the direction switching drive means (93) has a rather simpler structure and the number of components has been further increased, it is possible to make the device relatively small.

In the devices of the third and fourth embodiments the restriction area of the counterbalance valve (67) has been controlled using pilot pressures. However instead of counterbalance valve (67) it also obviously possible to install for example a solenoid valve whose restriction area may be controlled electrically and to control the restriction area of such a solenoid valve in accordance with the pressure on the outlet side of the solenoid proportional flow control valve (53), $P_2$ detected by pressure sensor (86) in the same way as in the third and fourth embodiments. Also, it is also possible to perform the kind of control used in the first and second embodiments wherein the restriction area is decreased only if pressure $P_2$ falls below a predetermined value.

Further, in the devices of the third and fourth embodiments, the logic valves (45), (46), (47) and (48) were used to switch the direction of operation of the hydraulic cylinder. However it is also possible to use direction switching valves which are switchable in and on and off sense. In all of the above described embodiments, a device for controlling a hydraulic cylinder to drive a hydraulic shovel has been described. However, this invention is not restricted to such and it is obvious to one skilled in the art that this invention could be applied to other actuators such as a hydraulic motor and to other kinds of machinery such as timber or building machinery.

I claim:

1. A hydraulic device comprising:

a hydraulic pump;

a hydraulic actuator having inlet and outlet side fluid chambers;

a pressure sensor positioned for detecting a value indicative of a fluid pressure at said inlet side fluid chamber;

actuator fluid lines leading from each of said fluid chambers;

a pump fluid line leading from said pump;

a fluid tank fluid line leading to a fluid tank;

a direction switching unit connected to said actuator lines, said fluid line, and said pump fluid line;

an operating lever to be operated by an operator;

direction switching unit drive means connected to said operating lever and to said direction switching unit for driving said direction switching unit;

an inflow variable restriction located between said pump and said actuator fluid lines;

pressure difference controlling means for controlling the difference in pressure between inlet and exit ports of said inflow variable restriction;

inflow variable restriction control means connected to said inflow variable restriction and to said operating lever for controlling said inflow variable restriction in accordance with the degree of operation of said operating lever;

an outflow variable restriction located in between said fluid tank and said actuator fluid lines and whose restriction area may be controlled independently of the restriction area of the inflow variable restriction; and outflow variable restriction control means connected to said outflow variable restriction for controlling said outflow variable restriction as a function of a comparison of fluid pressure at said inlet side fluid chamber with a fluid pressure value indicative of cavitation in said inlet side fluid chamber.

2. The hydraulic device according to claim 1 wherein said outflow variable restriction and said direction switching unit are combined in the form of a spool-type directional control valve in which the restriction area of outflow passages of said directional control valve changes with the displacement of a spool of said directional control valve from a center position over the range of the displacement of the spool, and in which the restriction area of the inflow passages reaches a maximum value with only a small displacement of the spool from a center position; and said inflow variable restriction is installed in said pump fluid line.

3. The hydraulic device according to claim 1 wherein said pressure sensor comprises pressure detecting means connected to said pump fluid line downstream of said inflow variable restriction means and to said outflow variable restriction control means.

4. The hydraulic device according to claim 1, further comprising a restriction of fixed restriction area installed in parallel with said outflow variable restriction.

5. A hydraulic device comprising:

a hydraulic pump;

a hydraulic actuator having two fluid chambers;

actuator fluid lines leading from each of said fluid chambers;

a pump fluid line leading from said pump;

a fluid tank fluid line leading to a fluid tank;

a direction switching unit connected to said actuator lines, said fluid tank fluid line, and said pump fluid line, said direction switching unit comprising a set of inflow and outflow logic valves;

an operating lever to be operated by an operator;

direction switching unit drive means connected to said operating lever and to said direction switching unit for driving said direction switching unit;

an inflow variable restriction located between said pump and said actuator fluid lines;

pressure difference controlling means for controlling the difference in pressure between inlet and exit ports of said inflow variable restriction;

inflow variable restriction control means connected to said inflow variable restriction and to said operating lever for controlling said inflow variable restriction in accordance with the degree of operation of said operating lever;

an outflow variable restriction located in between said fluid tank and said actuator fluid lines and whose restriction area may be controlled independently of the restriction area of the inflow variable restriction; and outflow variable restriction control means connected to said outflow variable restriction for controlling said outflow variable restriction.

6. The hydraulic device according to claim 5 wherein said set of inflow and outflow logic valves comprises an inflow logic valve connected in between each of said actuator fluid lines and said pump fluid line; and an outflow logic valve connected in between each of said actuator fluid lines and said fluid tank fluid line; and wherein said inflow variable restriction is installed in said pump fluid line and said outflow variable restriction is installed in said tank fluid line.

7. A hydraulic device comprising:

a hydraulic pump;

a hydraulic actuator having inlet and outlet side fluid chambers;

an inflow variable restriction located between said pump and said hydraulic actuator;

an inflow variable restriction controller connected to said inflow variable restriction so as to control said inflow variable restriction;

an outflow variable restriction located in between a fluid tank and actuator fluid lines; and an outflow variable restriction controller independent of said inflow variable restriction controller and connected to said outflow variable restriction so as to control said outflow variable restriction as a function of a comparison of a fluid pressure at said inlet side fluid chamber of said hydraulic actuator with a fluid pressure value indicative of cavitation in said inlet side fluid chamber.

8. The hydraulic device according to claim 7, including a direction switching unit connected to said hydraulic actuator, wherein said outflow variable restriction and said direction switching unit are combined in the form of a spool-type directional control valve in which the restriction area of outflow passages of said directional control valve changes with the displacement of a spool of said directional control valve from a center position over the range of the displacement of the spool, and in which the restriction area of the inflow passages reaches a maximum value with only a small displacement of the spool from a center position.

9. The hydraulic device according to claim 7, further comprising a pressure sensor positioned for detecting a value indicative of a fluid pressure at said inlet side fluid chamber.

10. The hydraulic device according to claim 7, further comprising a restriction of fixed restriction area installed in parallel with said outflow variable restriction.

11. A hydraulic device comprising:

a hydraulic pump;

a hydraulic actuator having inlet and outlet side fluid chambers;

a pressure sensor positioned for detecting a value indicative of a fluid pressure at said inlet side fluid chamber;

actuator fluid lines leading from each of said fluid chambers;

a pump fluid line leading from said pump;

a fluid tank fluid line leading to a fluid tank;

a direction switching unit connected to said actuator lines, said fluid tank fluid line, and said pump fluid line;

an operating lever to be operated by an operator;

direction switching unit driver connected to said operating lever and to said direction switching unit for driving said direction switching unit;

an inflow variable restriction located between said pump and said actuator fluid lines;

a pressure difference controller controlling the difference in pressure between inlet and exit ports of said inflow variable restriction;

an inflow variable restriction controller connected to said inflow variable restriction and to said operating lever to control said inflow variable restriction in accordance with the degree of operation of said operating lever;

an outflow variable restriction located between said fluid tank and said actuator fluid lines and whose restriction area may be controlled independently of the restriction area of the inflow variable restriction; and an outflow variable restriction controller connected to said outflow variable restriction to control said outflow variable restriction as a function of a comparison of the fluid pressure at said inlet side fluid chamber with a fluid pressure value indicative of cavitation in said inlet side fluid chamber.

12. The hydraulic device according to claim 11 wherein said outflow variable restriction and said direction switching unit are combined in the form of a spool-type directional control valve in which the restriction area of outflow passages of said directional control valve changes with the displacement of a spool of said directional control valve from a center position over the range of the displacement of the spool, and in which the restriction area of the inflow passages reaches a maximum value with only a small displacement of the spool from a center position; and said inflow variable restriction is installed in said pump fluid line.

13. The hydraulic device according to claim 11 wherein said pressure sensor comprises a pressure detecting means connected to said pump fluid line downstream of said inflow variable restriction and to said outflow variable restriction controller.

14. The hydraulic device according to claim 11, further comprising a restriction of fixed restriction area installed in parallel with said outflow variable restriction.

15. The hydraulic device according to claim 11, further comprising means for producing an operating speed of said hydraulic actuator corresponding to a degree of operation of said operating lever.

* * * * *